US007552985B2

(12) United States Patent
Kawatoko et al.

(10) Patent No.: US 7,552,985 B2
(45) Date of Patent: Jun. 30, 2009

(54) IMAGE PRINTING APPARATUS AND IMAGE PRINTING METHOD

(75) Inventors: Norihiro Kawatoko, Yokohama (JP); Hidehiko Kanda, Yokohama (JP); Toshiyuki Chikuma, Kawasaki (JP); Hirokazu Yoshikawa, Kawasaki (JP); Masashi Hayashi, Sagamihara (JP); Jiro Moriyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 78 days.

(21) Appl. No.: 11/836,374

(22) Filed: Aug. 9, 2007

(65) Prior Publication Data

US 2008/0049060 A1 Feb. 28, 2008

(30) Foreign Application Priority Data

Aug. 23, 2006 (JP) ..... 2006-227177

(51) Int. Cl.
*B41J 2/205* (2006.01)

(52) U.S. Cl. ..... 347/15

(58) Field of Classification Search ..... 347/15, 347/43, 12, 40; 358/1.2, 1.9, 3.02–3.06
See application file for complete search history.

(56) References Cited

U.S. PATENT DOCUMENTS

| | | | | |
|---|---|---|---|---|
| 5,729,259 | A | 3/1998 | Gotoh et al. | 347/43 |
| 5,751,310 | A | 5/1998 | Yano et al. | 347/43 |
| 6,183,071 | B1 | 2/2001 | Sugimoto et al. | 347/85 |
| 6,257,143 | B1 | 7/2001 | Iwasaki et al. | 101/481 |
| 6,283,569 | B1 | 9/2001 | Otsuka et al. | 347/15 |
| 6,467,891 | B2 | 10/2002 | Moriyama et al. | 347/96 |
| 6,682,170 | B2 * | 1/2004 | Hotomi et al. | 347/43 |
| 6,702,415 | B2 | 3/2004 | Kanda et al. | 347/15 |
| 6,702,416 | B2 * | 3/2004 | Vanhooydonck | 347/15 |
| 6,805,422 | B2 | 10/2004 | Takahashi et al. | 347/15 |
| 6,846,066 | B2 * | 1/2005 | Teshikawara et al. | 347/40 |
| 6,942,310 | B2 | 9/2005 | Kanda et al. | 347/15 |

FOREIGN PATENT DOCUMENTS

| | | |
|---|---|---|
| JP | 10-071730 | 3/1998 |
| JP | 2003-300312 | 10/2003 |
| JP | 2004-148723 | 5/2004 |
| JP | 2004-160913 | 6/2004 |

* cited by examiner

*Primary Examiner*—Lamson D Nguyen
(74) *Attorney, Agent, or Firm*—Fitzpatrick, Cella, Harper & Scinto

(57) ABSTRACT

In an image printing apparatus for printing an image by combining dots of a plurality of sizes, a banding problem attributable to variations in conveying operation, and a temperature rise of a print head with an increase of the number of ejections are solved with a relatively simple configuration. To this end, a combination of dots of a plurality of sizes is assigned to each of pixels expressed at a plurality level of density. In this assignment, a dot larger than a pitch of an image resolution is preferentially allocated to a pixel having a density level higher than that to which one dot smaller than the pitch of the image resolution is allocated.

7 Claims, 23 Drawing Sheets

| | SMALL DOT | LARGE DOT | DOT PATTERN |
|---|---|---|---|
| LEVEL 0 | 0 | 0 | 600dpi 600dpi |
| LEVEL 1 | 1 | 0 | |
| LEVEL 2 | 2 | 0 | |
| LEVEL 3 | 1 | 1 | 600dpi 600dpi |
| LEVEL 4 | 2 | 1 | |
| LEVEL 5 | 1 | 2 | |
| LEVEL 6 | 2 | 2 | |

FIG.2

| | SMALL DOT | LARGE DOT | INK APPLICATION AMOUNT (pl) | TOTAL NUMBER OF SMALL AND LARGE DOTS |
|---|---|---|---|---|
| LEVEL 0 | 0 | 0 | 0 | 0 |
| LEVEL 1 | 1 | 0 | 2 | 1 |
| LEVEL 2 | 2 | 0 | 4 | 2 |
| LEVEL 3 | 1 | 1 | 7 | 2 |
| LEVEL 4 | 2 | 1 | 9 | 3 |
| LEVEL 5 | 1 | 2 | 12 | 3 |
| LEVEL 6 | 2 | 2 | 14 | 4 |

| | SMALL DOT | LARGE DOT | DOT PATTERN |
|---|---|---|---|
| LEVEL 0 | 0 | 0 |   |
| LEVEL 1 | 1 | 0 |  |
| LEVEL 2 | 1 | 1 |   |
| LEVEL 3 | 1 | 2 |  |
| LEVEL 4 | 2 | 2 |  |

| | SMALL DOT | LARGE DOT | INK APPLICATION AMOUNT (pl) | TOTAL NUMBER OF SMALL AND LARGE DOTS | RATIO OF NUMBER OF DOTS IN EXAMPLE 1 TO NUMBER OF DOTS IN CONVENTIONAL EXAMPLE |
|---|---|---|---|---|---|
| LEVEL 0 | 0 | 0 | 0 | 0 | |
| LEVEL 1 | 1 | 0 | 2 | 1 | |
| | 1 | 0.4 | 4 | 1.4 | 70% |
| LEVEL 2 | 1 | 1 | 7 | 2 | |
| | 1 | 1.4 | 9 | 2.4 | 80% |
| LEVEL 3 | 1 | 2 | 12 | 3 | |
| LEVEL 4 | 2 | 2 | 14 | 4 | |

| | SMALL DOT | LARGE DOT | DOT PATTERN |
|---|---|---|---|
| LEVEL 0 | 0 | 0 |   |
| LEVEL 1 | 1 | 0 |   |
| LEVEL 2 | 1 | 1 |   |
| LEVEL 3 | 1 | 2 |  |
| LEVEL 4 | 2 | 2 |  |

| | SMALL DOT | MIDDLE DOT | LARGE DOT |
|---|---|---|---|
| LEVEL 0 | 0 | 0 | 0 |
| LEVEL 1 | 1 | 0 | 0 |
| LEVEL 2 | 1 | 1 | 0 |
| LEVEL 3 | 1 | 2 | 0 |
| LEVEL 4 | 0 | 1 | 1 |

DOT PATTERN

| | SMALL DOT | MIDDLE DOT | LARGE DOT | DOT PATTERN |
|---|---|---|---|---|
| LEVEL 0 | 0 | 0 | 0 |   |
| LEVEL 1 | 1 | 0 | 0 |   |
| LEVEL 2 | 1 | 1 | 0 |   |
| LEVEL 3 | 1 | 2 | 0 |   |
| LEVEL 4 | 0 | 1 | 1 |   |
| LEVEL 5 | 2 | 2 | 2 |  |

| | SMALL DOT | MIDDLE DOT | LARGE DOT |
|---|---|---|---|
| LEVEL 0 | 0 | 0 | 0 |
| LEVEL 1 | 1 | 0 | 0 |
| LEVEL 2 | 1 | 1 | 0 |
| LEVEL 3 | 0 | 1 | 1 |
| LEVEL 4 | 2 | 2 | 2 |

| | SMALL DOT | MIDDLE DOT | LARGE DOT |
|---|---|---|---|
| LEVEL 0 | 0 | 0 | 0 |
| LEVEL 1 | 1 | 0 | 0 |
| LEVEL 2 | 1 | 1 | 0 |
| LEVEL 3 | 0 | 1 | 1 |
| LEVEL 4 | 2 | 2 | 2 |

DOT PATTERN

IMAGE PRINTING APPARATUS AND IMAGE PRINTING METHOD

BACKGROUND OF THE INVENTION

1. Field of the Invention

The present invention relates to an image printing apparatus and an image printing method for forming an image on a printing medium with a plurality of dots of different sizes.

2. Description of the Related Art

Ink jet printing apparatuses are widely in use as information outputting device such as printers, copy machines and facsimiles. An ink jet printing apparatus includes a print head for ejecting ink as a droplet, and forms an image on a printing medium such as a paper sheet or a thin plastic plate, by printing dot patterns based on image information.

In a case of an ink jet printing apparatus, since an image is represented by printing or not printing a dot, granularity of dots in a highlight area (termed a lowest tone area) has been considered as a problem. To solve this problem, there is proposed an apparatus of printing images with a plurality of inks that are different from each other in terms of a density of coloring materials, like inks of cyan and light cyan, and inks of magenta and light magenta (for example, see Japanese Patent Laid-Open No. 2003-300312). With such an apparatus, granularity can be reduced by using inks of light cyan and light magenta in a highlight area. An increase of kinds of used inks (consumable items), however, leads to an upsizing of an apparatus and an increase of running costs.

On the other hand, a demand for printing an image in much higher resolution has been increasing. To satisfy this demand, a printing element in a print head has been improved with higher definition and smaller droplets. In recent years, there have been provided a large number of ink jet printing apparatuses each capable of ejecting ink droplets of 1 to 2 pl with high density and high resolution of more than 1200 dpi. A printing apparatus capable of making a print with higher definition and smaller droplets can achieve both a reduction in the foregoing granularity and an increase in resolution of images, concurrently.

When the higher resolution of an image is achieved, however, the number of pixels that should be subjected to image processing increases, and this may result in an increase of a load and a processing time of the image processing. Nevertheless, this problem can be solved by introducing binarization processing called "INDEX patterning processing" to the image processing.

In general, image data to be printed by a printing apparatus is represented with luminance data containing multiple values such as R (red), G (green) and B (blue). In contrast, in a case of an ink jet printing apparatus, an image is represented with dots printed or not-printed by using inks such as C (cyan), M (magenta), Y (yellow) and K (black). For this reason, various steps of image processing are needed for converting the multivalued luminance data (RGB) into binary density data (CMYK). The various steps include processing of converting multivalued luminance data (256 values, for example) into multivalued density data (similarly, 256 values), processing of converting the multivalued density data into density data using a smaller number of levels (5 values), and the like. Moreover, the various steps also include the INDEX patterning processing of converting the density data using a smaller number of levels (5 values) into binary density data.

FIG. 1 is a schematic diagram for explaining the INDEX patterning processing. FIG. 1 shows patterns for converting density data of 5 values (levels 0 to 4) with a resolution of 600 dpi into binary (print/not-print) density data with a resolution of 1200 dpi. In this example, 1 pixel of 600 dpi is the minimum unit for the image processing before the INDEX patterning processing, and 1 pixel of 1200 dpi is the minimum unit for specifying whether or not to print a dot after the INDEX patterning processing. 1 pixel of 600 dpi is equivalent to an area of 2 pixels×2 pixels of 1200 dpi. The higher the level (the density value), the greater the number of dots printed. By providing the INDEX patterning processing like this to the final stage of the image processing including various steps, the number of pixels that should be treated in the image processing therebefore can be reduced. This results in a decrease in a load and a processing time of the entire image processing. Hereinafter, in this description, a resolution (600 dpi in this example) before the INDEX patterning processing is referred to as an image resolution, and a resolution (1200 dpi in this example) after the INDEX patterning processing is referred to a printing resolution. In other words, 1 pixel of the image resolution is an area that can be represented with n (n is an integer at least 3) levels of density (n tones), and 1 pixel of the printing resolution is an area that can be represented with 2 levels of density (dot-on/dot-off). Accordingly, the employing of the aforementioned INDEX patterning processing allows an image to be outputted with small droplets, a high printing resolution and less granularity.

Nevertheless, there is a problem specific to a print head that can eject only small droplets. Indeed, a single small dot formed on a printing medium by a small droplet of ink is not likely to be noticed, and thus reduces the granularity in a highlight area. However, a larger number of dots need to be printed in order to represent a sufficiently high density. This results in an increase of the number of times that the print head ejects droplets, and thereby leads to conditions that are more likely to increase the temperature of the print head. It is desirable that the temperature of the print head be kept within a predetermined range in order for the print head to eject ink droplets normally and stably. When the temperature of the print head increases too much, an action of suspending the printing operation or the like is taken in general. Such a suspension, however, leads to a decrease of a printing speed.

In order to solve the foregoing problems, a printing method using a print head capable of ejecting ink droplets of several different size levels has been proposed in recent years, and a printing apparatus employing such a method has also been provided. A printing apparatus capable of ejecting ink droplets of several different size levels can efficiently carry out gradation representation while curbing granularity, by printing small dots in a highlight area, and by printing large dots in a high density area. In addition, this method does not require the upsizing of an apparatus, and an increase of running costs unlike a case of additionally using light color inks each having a low density of coloring materials.

An effective structure for a print head capable of printing with high density at a high speed is one provided with a heater (an electrothermal element) in an ink path in each printing element. In such a print head, a bubble is generated in an ink by applying a voltage pulse to a heater, and then the ink is ejected from an ejection port with growing energy of the bubble.

Japanese Patent Laid-Open No. Hei 10-071730 discloses an ink jet printing apparatus which includes a heater for a large dot and a heater for a small dot in each printing element, and which thereby is capable of printing both large and small dots in the same print scan. In addition, Japanese Patent Laid-Open No. 2004-148723 discloses the scheme in which image data for large dots and image data for small dots are each independently quantized to reduce the number of levels and then are respectively assigned dot matrix patters (INDEX patterns) that are independently prepared. This patent document describes the scheme in which the dot matrix patterns are determined so that large and small dots are not printed overlappingly in the same pixel of a printing resolution.

Moreover, Japanese Patent Laid-Open No. 2004-160913 discloses an apparatus for printing an image with a print head capable of printing dots of three size levels, that is, small, middle and large. This patent document describes a scheme for making an adjustment of each apparatus or making an adjustment depending on an age deterioration of a print head, for the purpose of curbing banding in the following manner. Firstly, a plurality of patterns with different mixing ratios of small, middle and large dots are printed. Then, among the printed pattern images, one having less banding is selected and set for printing.

In this way, the use of a print head capable of ejecting ink droplets of several different size levels, and the introduction of the INDEX patterning processing results in achievements of reduction of granularity in a highlight area, effective tone representation in a high density area and speedup of image processing and printing operation, all together.

However, even in a case of employing the aforementioned techniques, it has been recently considered as a problem that banding is easily noticed in a tone area in which the density is mainly represented by a large number of small dots. This phenomenon has harmful effects especially on serial-type ink jet printing apparatuses used in a wide range of fields.

In a serial-type printing apparatus, an image is formed intermittently by alternately performing main scans and sub-sub scans. Here, in the mainmain scan, a print head moves relative to a printing medium while ejecting ink. On the other hand, in the subsub scan, the printing medium is conveyed by a predetermined amount in a direction orthogonal to a direction of the mainmain scan. With this configuration, the serial-type printing apparatus has various advantages that: the serial-type apparatus can be downsized more than other types; various sizes of printing media can be handled; colors can be relatively easily increased; a speed and printing quality can be adjusted easily by introducing a multi-pass print mode; and the like.

However, the conveying amount in a sub scan inevitably varies to some extent due to the eccentricity of rollers conveying a printing medium and the like. Under this condition, when smaller dots are uniformly printed, variations in the conveying amount generate dot-dense portions and dot-sparse portions in the sub scan direction. These dot-dense and dot-sparse portions are more likely to be noticed as density unevenness.

Hereinafter, the aforementioned harmful effect will be described more specifically by referring to the drawings.

FIG. 2 shows a schematic diagram for explaining INDEX patters used in an ink jet printing apparatus that forms an image with large and small dots. FIG. 2 shows patterns each specifying whether or not to print large and small dots in each printing pixel in a printing resolution of 600 dpi (vertical)× 1200 dpi (horizontal), corresponding to density data having 7-valued levels with an image resolution of 600 dpi. The width of 1 pixel of 600 dpi is approximately 42 μm, and that of 1200 dpi is approximately 21 μm. On the other hand, the diameter of a large dot used in this example is 60 μm, and that of a small dot is approximately 35 μm.

The left side of the table shown in FIG. 2 shows the numbers of small dots and large dots to be printed in 1 pixel of the image resolution, corresponding to each level. The right side of the table shows a dot printing state corresponding to each of the levels. It is obvious that dots to be printed increase in number and size as the level becomes higher. Here, pay attention to the level 2. The level 2 is a tone value that is formed only by small dots in this example.

FIGS. 3A and 3B are diagrams showing dot alignment states in a case where data of the level 2 is continuously printed on a certain range of area. To print this, a multi-pass printing method is employed, and multiple small dots in the area are printed in multiple main scans with multiple sub scans each performed between the main scans. FIG. 3A shows a state printed without variation in the multiple sub scans, and FIG. 3B shows a state printed with variations therein.

The diameter of the small dot (35 μm) is smaller than the width (42 μm) of 1 pixel of the image resolution. Accordingly, if there is no variation in the sub scans, as shown in FIG. 3, the small dots aligned in the sub scan direction are not in contact with each other, and lines are formed extending in a main scan direction with white background portions sandwiched from above and below. In addition, the presence of the white background portions means that coverage (a ratio of an area covered with ink to an entire area for printing an image) on a printing medium is less than 100%. The presence of the white background portions increases the lightness.

On the other hand, if there are variations in the sub scans, as shown in FIG. 3B, the small dots aligned in the sub scan direction are arranged in contact with or away from each other, and small white background portions are formed irregularly. In this case, coverage on a printing medium is greater than in the case shown in FIG. 3A, and thereby the lightness is lowered. Such lightness and coverage are influenced by a contact between ink droplets before being fixed on a printing medium.

FIGS. 4A and 4B are magnified diagrams focusing on boundary areas in the sub direction shown in FIGS. 3A and 3B, respectively. As shown in FIG. 4A, when a white background portion exists between dots aligned in the sub scan direction, the dots aligned in the sub scan directions are not in contact with each other, and maintain a distance therebetween. On the other hand, in the case where there are variations in the sub scans, portions where dots aligned in the sub scan direction are in contact with each other appear as shown in FIG. 4B.

If the ink droplets are brought into contact with each other before being absorbed by the printing medium, the ink droplets are attracted to each other by their surface tension, which causes a phenomenon in which the ink flows from one of the ink droplets into the other thereof. In other words, the ink flows in main scan directions but does not flow in the sub scan direction in the case of FIG. 4A, while the ink flows both in the main and sub scan directions in the case of FIG. 4B. When such a flowing phenomenon occurs, the dots become deformed, and change the shape so as to expand the covering area. As a result, the coverage is increased. In other words, a contact between ink droplets is a factor of further increasing a change of the coverage due to variations in sub scans.

If there are variations in sub scans, the coverage and lightness also vary by conveying width on a printing medium. When a conveyance roller is decentered, the variations in the conveying amount periodically appear, and thereby the variations in lightness also appear periodically in the sub scan direction. Since a human visual sense is sensitive to the variations in lightness, such a phenomenon is noticed as banding or density unevenness, and is an important problem in regard to image quality.

Another method has been proposed for printing small dots shifted in the sub scan direction in order to eliminate a white background portion continuously extending in a main scan direction, at a tone level at which a print is made only with small dots. However, for the purpose of printing dots while aggressively shifting the dots in the sub scan direction, this method requires that printing elements be arranged with higher density in a print head, or that the conveying amount in the sub scan performed between two successive main scans be set so that dots can be arranged in shifted positions. The former case leads to an increase of costs for a print head since a larger number of printing elements need to be arranged with high density. In the meantime, the latter case results in an increase of costs for a printing apparatus, itself, since the printing apparatus is consequently required to convey printing media with higher definition.

As described above, Japanese Patent Laid-Open No. 2004-160913 discloses a technique of reducing banding in a way that a plurality of patterns with different mixing ratios of dots of different sizes are printed firstly, that then one of the printed images having the least banding is selected, and that the pattern of the selected image is set to actually make a print. However, in this case, an adjustment step for reducing banding is needed in addition to a normal printing operation, which may make it less easy for users to make a print. In addition, as compared with general printing apparatuses, a printing apparatus employing this technique additionally requires a large number of device, such as device for printing a plurality of patterns with different mixing ratios of dots of different sizes, and device for modifying image processing according to obtained values for adjustment. The providing of a large number of device results in an increase in complicatedness of control in an apparatus main body and a host computer, and an increase of costs for a printing apparatus.

Any of the methods described above accompanies an increase in complicatedness of control and a large increase in costs, and accordingly is not practical. For this reason, there is a demand for a simpler and more secure method for reducing banding with low duty.

SUMMARY OF THE INVENTION

The present invention has been made in consideration of the foregoing problems. Accordingly, an object of the present invention is to solve a banding problem, which may occur due to variations in sub scans, with a relatively simple configuration in an image printing apparatus printing an image with dots of a plurality of sizes in combination.

The first aspect of the present invention is an image printing apparatus for printing an image on a printing medium by using dots of a plurality of sizes comprising: determining unit that determines which and how many of the dots to be used for printing a pixel in accordance with a level of density of the pixel capable of representing n (n is an integer at least 3) levels of density; and printing unit that prints each dot determined by the determining unit in the pixel on the printing medium, wherein, the dots of a plurality of sizes including at least a small dot smaller than the pixel and a large dot larger than the pixel, and wherein, in a case of printing the pixel with density one level higher than that represented by using one the small dot, the determining unit determines which and how many of the dots to be used for printing the pixel so that at least one the large dot would be used.

The second aspect of the present invention is an image printing apparatus for printing an image on a printing medium by main scanning operation in which a print head capable of printing dots of a plurality of sizes on the printing medium is caused to scan in a main scanning direction, and by conveying operation in which the printing medium is conveyed in a conveying direction orthogonal to the main scanning direction, comprising: determining unit that determines, in accordance with a level of density in a pixel capable of representing n (n is an integer at least 3) levels of density, which and how many of the dots to be used for printing the pixel and a print position of each determined dot in the pixel; and printing unit that makes a print on the printing medium with the print head in accordance with each dot and the print position thereof thus determined by the determining unit; wherein, in a case of printing the pixel with density one level higher than that represented by using one small dot smaller than the pixel, the determining unit determines dots and print positions to be used for printing the pixel so that the small dot and a dot of one of the plurality of sizes would be used, and that the latter dot would be printed on a position adjacent to the small dot in the conveying direction.

The third aspect of the present invention is an image printing apparatus for printing an image on a printing medium by using dots of a plurality of sizes, comprising: determining unit that determines which and how many of the dots to be used for printing a pixel in accordance with a level of density in the pixel capable of representing n (n is an integer at least 3) levels of density; and printing unit that prints each dot determined by the determining unit in the pixel on the printing medium, wherein, the dots of a plurality of sizes including at least a small dot smaller than the pixel and a large dot larger than the pixel, and a middle dot larger than the small dot and smaller than the large dot, wherein, in a case of printing the pixel with a predetermined level of density which is higher than that represented by using one the small dot, and which is lower than that represented by using one the large dot, the determining unit determines which and how many of the dots to be used for printing the pixel so that at least one the middle dot would be used.

The fourth aspect of the present invention is an image printing apparatus for printing an image on a printing medium by using dots of a plurality of sizes, comprising: determining unit that determines which and how many of the dots to be used for printing a pixel in accordance with a level of density in the pixel capable of representing n (n is an integer at least 3) levels of density; and printing unit that prints each dot determined by the determining unit in the pixel on the printing medium, wherein, in a case of printing the pixel with a level of density which is higher than that represented by using one small dot smaller than the pixel, and which is equal to or lower than that having an ink coverage on the pixel of 100% or more, the determining means determines which and how many of the dots to be used for printing the pixel so that at least one dot larger than the small dot would be used.

The fifth aspect of the present invention is an image printing apparatus for printing an image on a printing medium by performing a main scan operation in which a print head capable of printing dots of a plurality of sizes on the printing medium is caused to scan in a main scanning direction, and by performing a conveying operation in which the printing medium is conveyed in a conveying direction orthogonal to the main scanning direction, comprising: determining unit that determines which and how many of the dots to be used for printing a pixel in accordance with a level of density in the pixel capable of representing n (n is an integer at least 3) levels of density; and printing unit that prints each dot determined by the determining unit in the pixel on the printing medium, wherein, in a case of printing the pixel having a determined level of density which is higher than that represented by using one small dot smaller than the pixel, and which is equal to or lower than that having an ink coverage on the pixel of 100% or more in the conveying direction, the determining unit determines which and how many of the dots to be used for printing the pixel so that at least one dot larger than the small dot would be used.

The sixth aspect of the present invention is an image printing apparatus for printing an image on a printing medium by using a print head in which a plurality of printing elements for printing dots are arranged, comprising; determining unit that determines which and how many of the dots to be used for printing a pixel in accordance with a level of density in the pixel; and printing unit that prints each dot determined by the determining unit in the pixel on the printing medium, wherein, the print head can print dots of a plurality of sizes including at least a small dot having a diameter smaller than a width corresponding to an array pitch of the printing elements, and a large dot having a diameter larger than the width, and wherein, in a case of printing the pixel with a level of density higher than that represented by using one the small dot, the determining unit determines which and how many of the dots to be used for printing the pixel so that at least one the large dot would be used.

The seventh aspect of the present invention is an image printing method for printing an image on a printing medium by using dots of a plurality of sizes, the method comprising the steps of: determining which and how many of the dots to be used for printing a pixel in accordance with a level of density in the pixel capable of representing n (n is an integer at least 3) levels of density; and printing each dot determined by the determination step in the pixel on the printing medium, wherein, the dots of a plurality of sizes including at least a small dot smaller than the pixel and a large dot larger than the pixel, and wherein, in the determination step, in a case of printing the pixel with density one level higher than that represented by using one the small dot, it is determined which and how many of the dots to be used for printing the pixel so that at least one the large dot would be used.

The eighth aspect of the present invention is an image printing method for printing an image on a printing medium by using dots of a plurality of sizes comprising the steps of: determining which and how many of the dots to be used for printing a pixel in accordance with a level of density of the pixel capable of representing n (n is an integer at least 3) levels of density; and printing each dot determined by the determination step in the pixel on the printing medium, wherein, the dots of a plurality of sizes including at least a small dot smaller than the pixel and a large dot larger than the pixel, and wherein, in a case of printing the pixel with density one level higher than that represented by using one the small dot, in the determination step it is determined which and how many of the dots to be used for printing the pixel so that at least one the large dot would be used.

Further features of the present invention will become apparent from the following description of exemplary embodiments (with reference to the attached drawings).

BRIEF DESCRIPTION OF THE DRAWINGS

FIG. 2 is a schematic diagram for explaining INDEX patterns in an ink jet printing apparatus that forms an image by using large and small dots;

DESCRIPTION OF THE EMBODIMENTS

Hereinafter, an exemplary embodiment of the present invention will be described with reference to the drawings. Incidentally, although an ink jet printing apparatus will be cited as an applied example in the following embodiment, the present invention is not limited to this. The present invention can be applied to any printing apparatus as long as the apparatus is capable of forming an image with a dot alignment using pulse-surface-area modulation.

Figure 6:
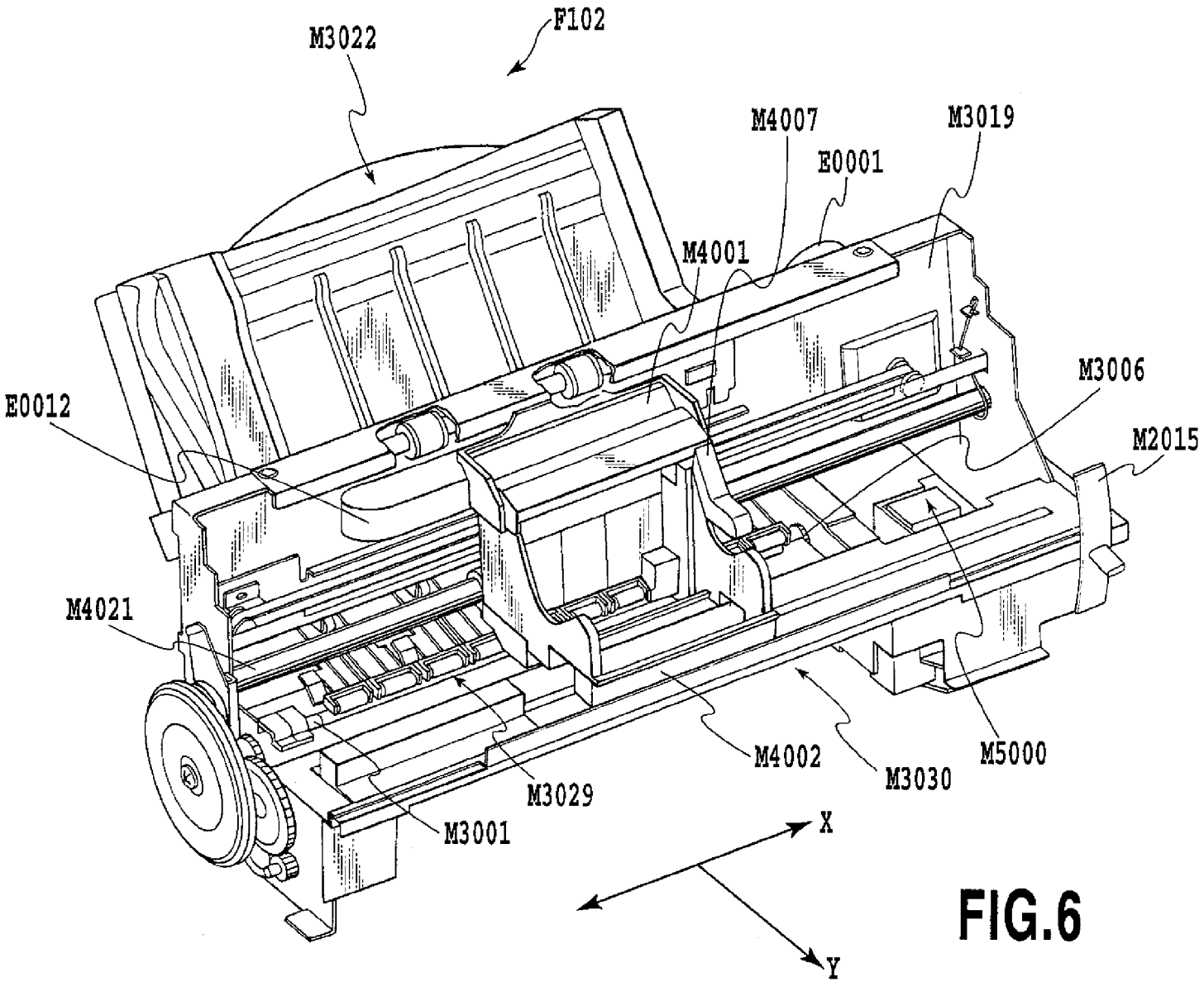
FIG. 6 is a view of a schematic configuration of a main part of an ink jet printing apparatus to which an embodiment is applied.

FIG. 6 is a view of a schematic configuration of a main part of an ink jet printing apparatus F102 to which this embodiment is applied. A chassis M3019 housed in an external package member of the printing apparatus F102 is composed of a plurality of plate-shape metal members each having a predetermined stiffness to form a frame of the printing apparatus, and includes each of the following mechanisms. An automatic feeding unit M3022 automatically feeds sheets (printing media) to the inside of a main body of the apparatus. A conveying unit M3029 guides sheets fed one by one from the automatic feeding unit M3022 to a predetermined print position, and then guides the sheets from the print position to a discharging unit M3030. An arrow Y is a conveying direction of sheets (a sub scan direction). A printing unit makes a print as desired on a sheet conveyed to the print position. A recovery unit M5000 performs a recovery process on this printing unit. Reference numerals M2015 and M3006 denote a paper-to-paper gap adjusting lever and a bearing of the conveyance roller M3001, respectively.

In the printing unit, a carriage M4001 is supported by a carriage shaft M4021 so as to be movable in main scan directions shown by an arrow X. An ink jet print head cartridge H1000 capable of ejecting ink is detachably mounted on the carriage M4001.

Figure 7:
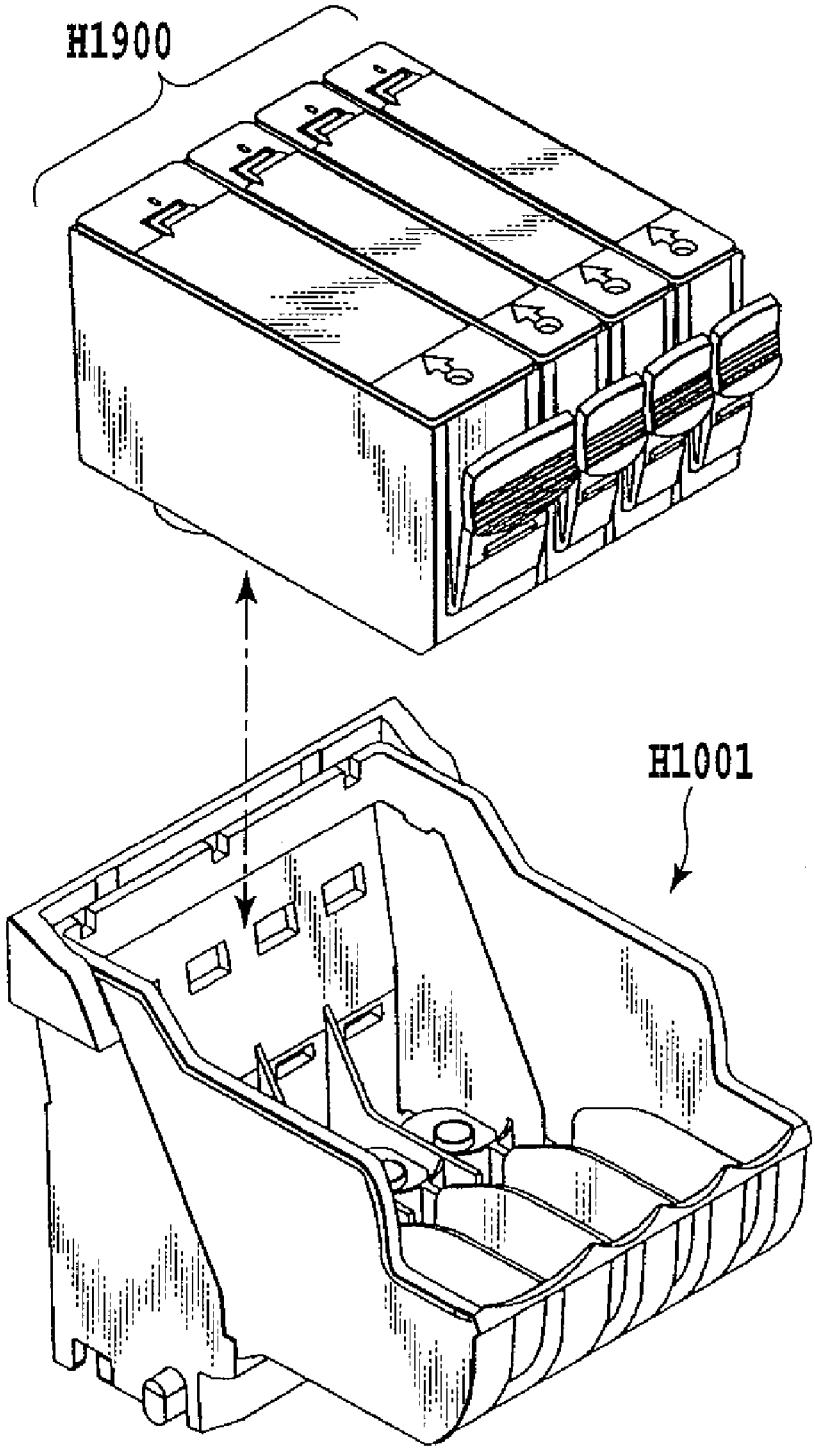
FIG. 7 is a perspective view for explaining a configuration of an ink jet printing cartridge applicable to this embodiment.

FIG. 7 is a perspective view for explaining a configuration of an ink jet printing cartridge applicable to this embodiment. A print head cartridge H1001 (hereinafter, also simply referred to as a print head) is composed of an ink tank holder and a print head portion having printing elements for ejection. Each of ink tanks H1900 is attachable to and detachable from the print head cartridge H1001 as shown in FIG. 7, and supplies an ink to a corresponding printing element array. In this embodiment, the print head H1001 is configured to use four color inks of black, cyan, magenta and yellow, and to be capable of ejecting each color ink of amounts at multiple levels.

The printing element of the print head H1001 in this embodiment has a mechanism that causes film boiling in ink by applying a voltage to a heater provided inside an ink path, and that causes a predetermined amount of ink to be ejected as an ink droplet. Ejection ports for ejecting ink of the same color and of the same amount are arranged in the sub scan direction at predetermined pitches, and ejection port arrays for respectively ejecting different amounts of ink are arranged side by side in a main scan direction.

Here, again, refer to FIG. 6. The carriage M4001 is provided with a carriage cover M4002 for guiding the print head H1001 to a predetermined mounting position on the carriage M4001. Moreover, the carriage M4001 is provided with a head set lever M4007 that sets the print head H1001 at a predetermined mounting position while being engaged with the tank holder of the print head H1001. The head set lever M4007 is provided so as to be rotatable about a head set lever shaft located at an upper portion of the carriage M4001. An engagement portion of the head set lever M4007 that is engaged with the print head H1001 is provided with a head set plate (not illustrated) biased by a spring. While pressing the print head H1001 with a force of the spring, the head set lever M4007 mounts the print head H1001 on the carriage M4001. The print head H1001 mounted on the carriage H4001 obtains head drive signals needed for printing from a main substrate E0001 through a flexible cable E0012.

The recovery unit M5000 is provided with a cap (not illustrated) for capping a surface of the print head cartridge H1001 having ink ejection ports formed thereon. A suction pump capable of introducing negative pressure into the inside of the suction pump may be connected to this cap. In this case, ink is sucked and discharged from the ink ejection ports by introducing negative pressure into the inside of the cap covering the ink ejection ports in the print head cartridge H1001. By the use of this, it is possible to perform recovery processing (also called "suction recovery processing") for maintaining the print head H1001 in good conditions for ink ejection. In addition, another type of recovery processing (also called "ejection recovery processing" or "preliminary ejection") for maintaining the print head H1001 in good conditions for ink ejection can be performed by causing the ink, which does not contribute to image printing, to be ejected to the inside of the cap.

Figure 8:
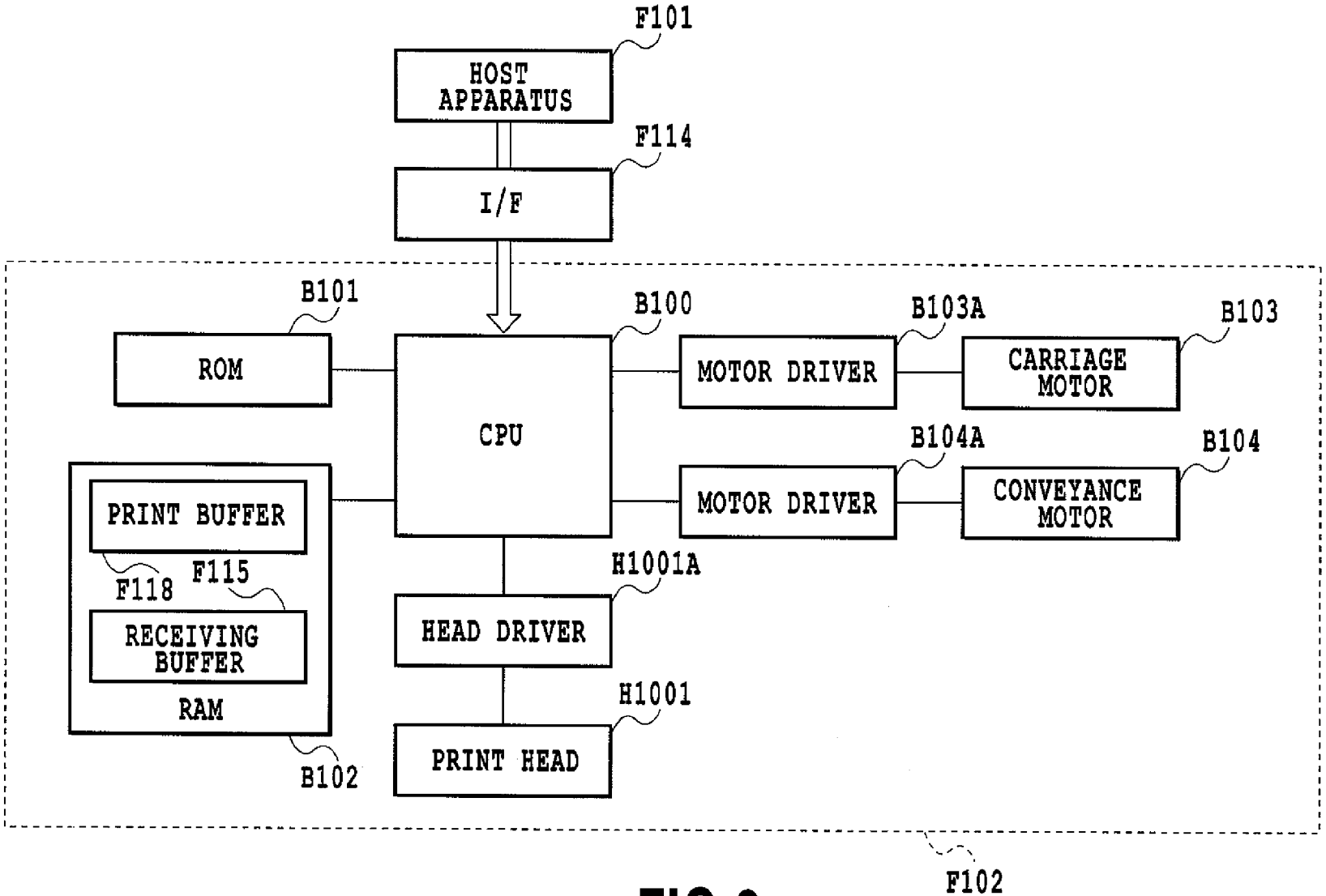
FIG. 8 is a schematic block diagram for explaining a configuration of a control system in the printing apparatus of this embodiment.

FIG. 8 is a schematic block diagram for explaining a configuration of a control system in the printing apparatus F102 of this embodiment. A CPU B100 executes control of operations of the entire printing apparatus F102, image data processing and the like. In a ROM B101, stored are programs needed for the CPU B100 to perform control, and data necessary for printing INDEX patterns specific to the present invention. The CPU B100 executes various types of processing by referring the programs and data stored in the ROM B101 as needed, and by using a RAM B102 as a work area. Besides such a work area, a receiving buffer F115 for temporarily storing received image data, a print buffer F118 for storing print data for driving the print head H1001 and the like are reserved in the RAM B102.

The printing apparatus F102 receives image data through an interface (I/F) F114 from a host apparatus F101 connected to the outside. The CPU B100 temporarily stores the received image data in the receiving buffer F115 in the RAM B102, and performs image processing on the received image data by using various parameters stored in the ROM B101. The resultant image data after a series of image processing are stored in the print buffer F118 in the RAM B102, and then are sequentially transferred to a head driver H1001A with progress of a printing operation of the print head H1001. The head driver H1001A drives the print head H1001 according to received print signals. The CPU B100 provides the head driver H1001A with drive data (print data) and drive control signals (heat pulse signals) for driving the electrothermal elements and the like, thereby causing the print head H1001 to ejects ink. The CPU B100 causes the carriage M4001 to scan at a predetermined speed by driving a carriage motor B103 with a carriage motor driver B103A, while causing the print head H1001 to eject the ink. In this way, one main scan for printing is executed. Upon completion of one main scan for printing, the CPU B100 causes a printing medium to be conveyed (sub scan) by a predetermined amount by driving a conveyance motor B104 with a conveyance motor driver B104A. An image received from the host apparatus F101 can be printed on a printing medium by repeating the main scan for printing and the sub scan alternately.

Figure 9:
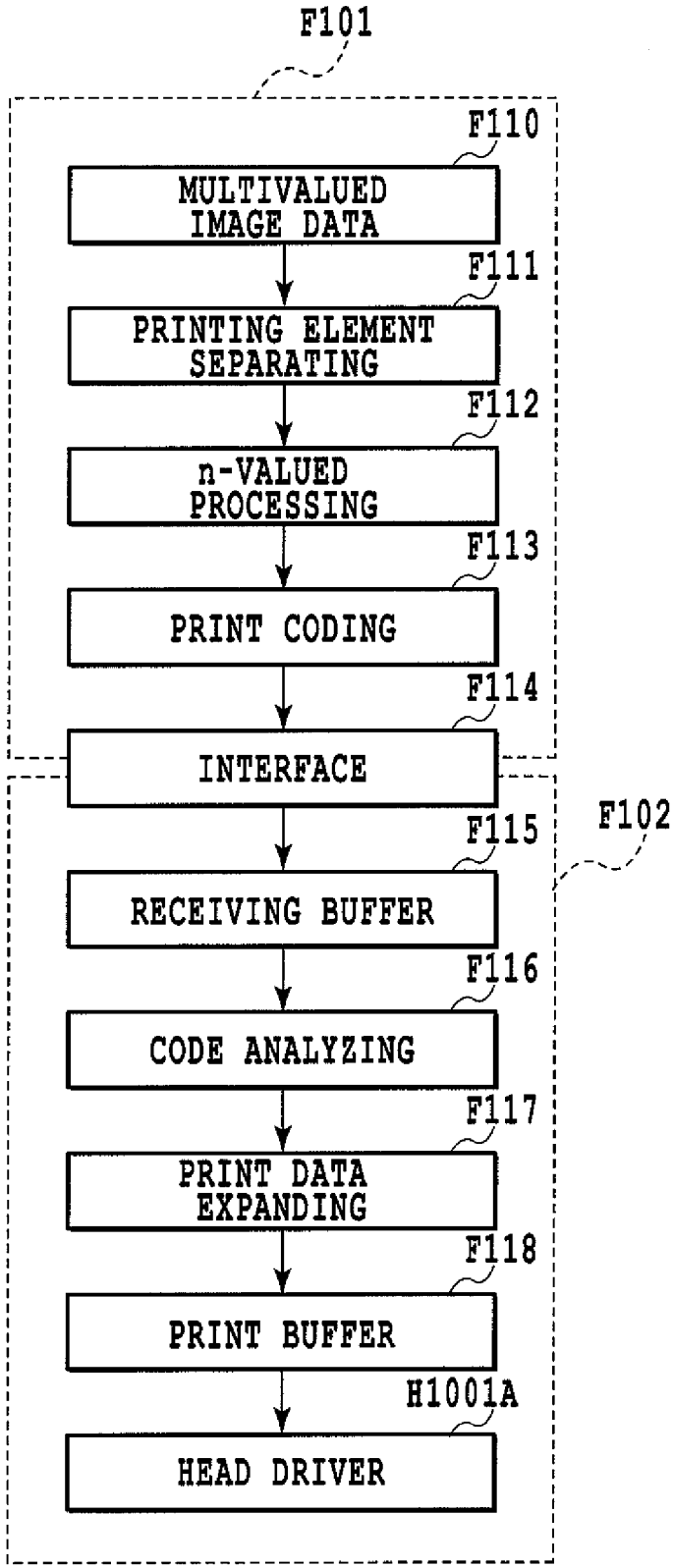
FIG. 9 is a block diagram for explaining a series of image processing steps performed by the printing apparatus of this embodiment, and a host apparatus that provides image data to the printing apparatus.

FIG. 9 is a block diagram for explaining a series of image processing steps performed by the printing apparatus F102 of this embodiment, and the host apparatus F101 that provides image data to the printing apparatus F102. In this embodiment, the host apparatus F101 firstly converts luminance data F110 of multiple values (8 bits (256 values)) of RGB into density data of multiple values (8 bits (256 values)) of CMYK corresponding to ink colors included in the printing apparatus. Here, the density data have an image resolution of 600 dpi. Subsequently, at n-valued processing, the host apparatus F101 converts the multiple-valued density data of each ink color into data of n values (n is an integer satisfying $3 \leqq n < 256$). In this embodiment, the host device quantizes 256 values into 5 values (6 values in Example 3) without changing the resolution by using a multi-level error diffusion method. Moreover, at print coding F113 the n-valued image data of 600 dpi is converted into command codes that the ink jet printing apparatus F102 can recognize. The 5-valued (or 6-valued) density data thus coded are transferred to the printing apparatus F102 through the interface F114.

The printing apparatus F102 temporarily stores the received image data in the receiving buffer F115, and then analyzes the codes stored in the receiving buffer F115 by code analyzing F116. The image data thus analyzed are expressed with 5 values (or 6 values) of 600 dpi. At print data expanding F117 INDEX expansion processing on these data is performed. Specifically, according to a density level of 1 pixel (1 pixel of 600 dpi) corresponding to an area represented with density at n (n is an integer at least 3) density levels (n tones), an INDEX pattern for printing the pixel is determined. Thus, the 5-valued (or 6-valued) density data of each color are converted into print data containing 2 values of each dot size of each color. The print data of each dot size of each color are individually expanded in the print buffer F118. As such, the print data expanding F117 is equivalent to determination step for determining dots to be used for printing the pixel. The print data expanded in the print buffer F118 are transferred to the print head driver H1001A. Then, the print head driver H1001A drives the printing elements of each size of each color in the print head H1001 according to the print data. Thereby, a color image is printed on a printing medium. Incidentally, hereinafter, the "levels" of the density data expressed with n values (5 values, 6 values or the like) are also referred to as the "tone levels" or "density levels."

Specific examples will be described below by using the ink jet printing apparatus described above.

EXAMPLE 1

Figure 10:
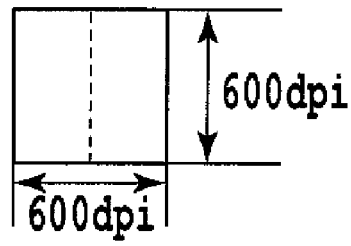
FIG. 10 is a diagram for explaining INDEX patterns used in Example 1 by comparing the conventional one shown in FIG. 2.
Figure 10:
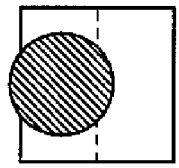
Figure 10:
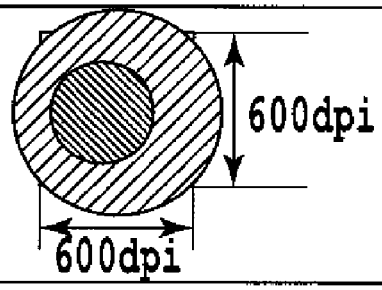
Figure 10:
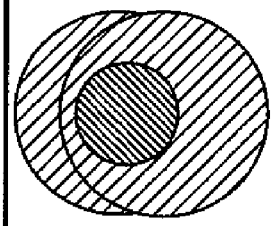
Figure 10:
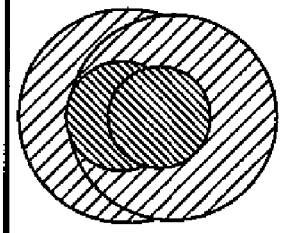

FIG. 10 is a diagram for explaining INDEX patterns used in Example 1 by comparing the conventional patterns shown in FIG. 2. FIG. 10 shows the patterns each specifying whether or not to print large and small dots in each printing pixel of a printing resolution of 600 dpi (vertical)×1200 dpi (horizontal), corresponding to density data having 5-valued levels of an image resolution of 600 dpi. In Example 1, the diameters of large and small dots are also 60 μm and 35 μm, respectively. In comparison with the patterns in FIG. 2, one large dot and one small dot are printed in 1 pixel of 600 dpi at the tone level 2 in Example 1. A characteristic of Example 1 is that there is no level at which two of only small dots are printed side by side in a main scan direction like the level 2 shown in FIG. 2.

Figure 1:
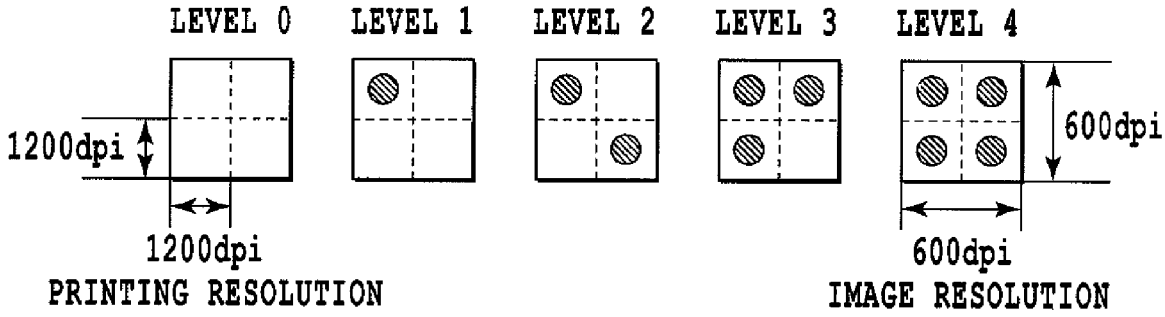
FIG. 1 is a schematic diagram for explaining INDEX patterning processing.
Figure 3A:
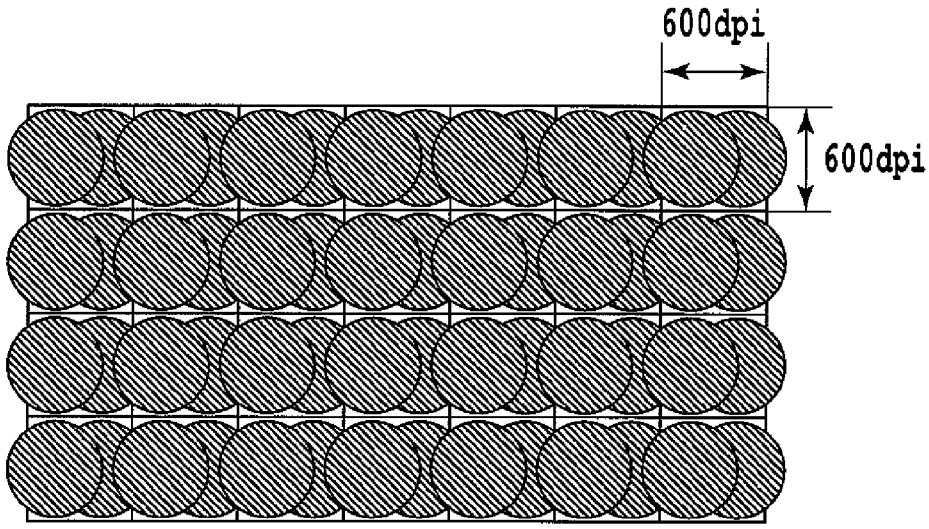
FIGS. 3A and 3B are diagrams each showing a dot alignment state in a case of continuously printing data of a level 2 on a certain range of area.
Figure 3B:
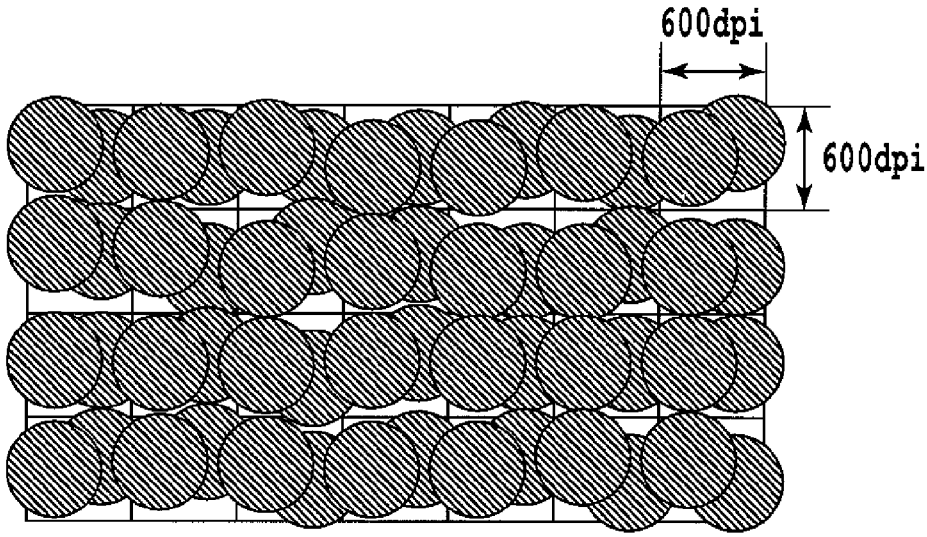
Figure 4A:
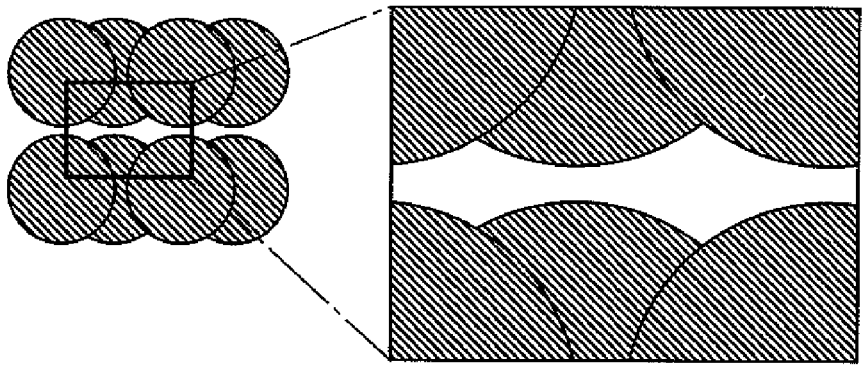
FIGS. 4A and 4B show magnified diagrams when focusing on boundary parts in a sub scan direction in FIGS. 3A and 3B, respectively.
Figure 4B:
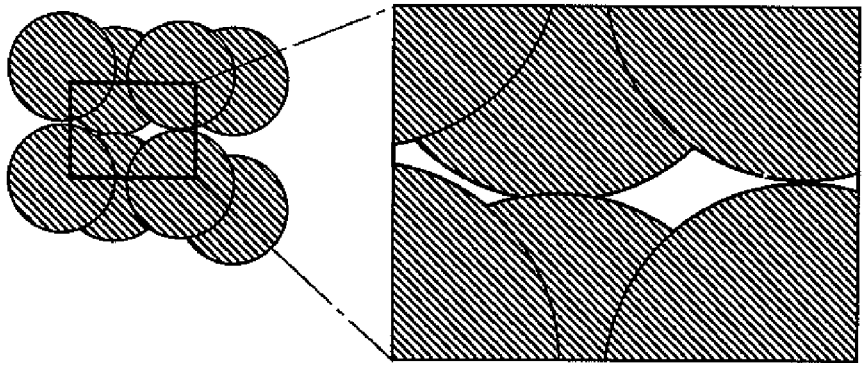
Figure 11A:
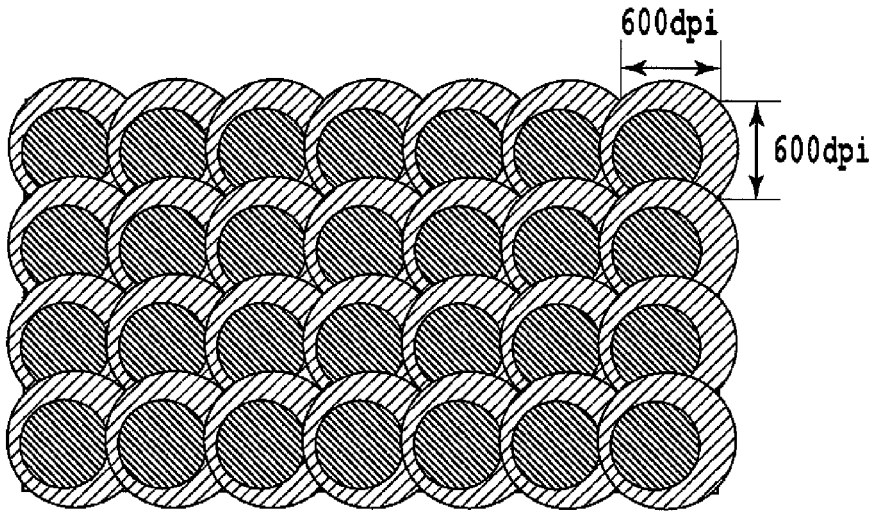
FIGS. 11A and 11B are diagrams showing dot alignment states in a case of printing data of level 2 in Example 1 on a certain range of area in comparison with FIGS. 3A and 3B.
Figure 11B:
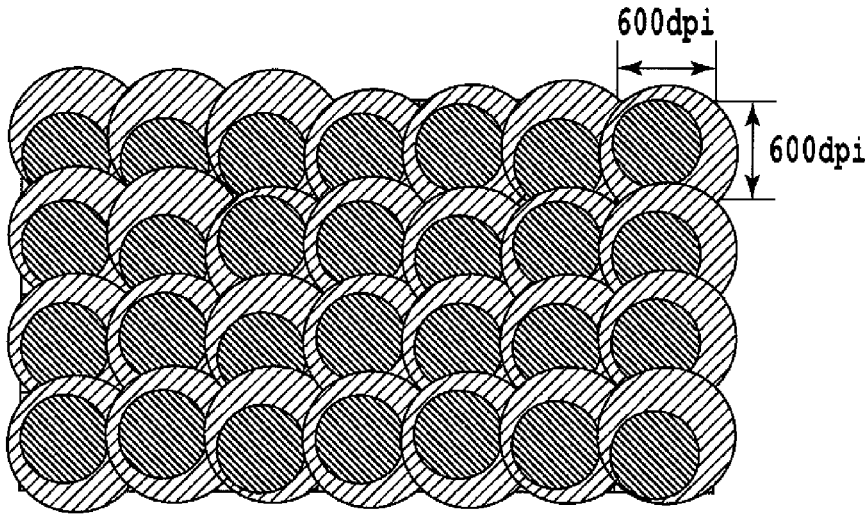

FIGS. 11A and 11B are diagrams each showing a dot alignment state in a case of continuously printing data at the level 2 of Example 1 on a certain range of area in comparison with FIGS. 3A and 3B. In Example 1, the multi-pass printing method is employed, and multiple dots in the area are printed in multiple main scans with multiple sub scans each performed between the main scans. FIG. 11A shows a state printed without variation in the multiple sub scans, and FIG. 11B shows a state printed with variations therein to the same extent as in the case of FIG. 3B.

In Example 1, since larger dots than a pitch of the image resolution in the sub scan direction are printed at the level 2, lines in the main scan direction, which are shown in FIG. 3A, are not observed. The coverage on the printing medium is also more than 100%.

Even under the condition that there are variations in the sub scans, a portion where dots overlap with each other serves as a margin to prevent the coverage from changing, because the diameter of the large dot is greater than the pitch of the image resolution. As a result, as indicated in FIG. 11B, the coverage hardly changes, and the coverage remains in a state of 100%. It has been pointed out in this description that a difference in lightness between such two states leads to a banding problem described in the section of "DESCRIPTION OF THE RELATED ART." In other words, in the state at the level 2 of Example 1, a difference in lightness as observed at the level 2 of the conventional example is not observed, and thus banding attributable to the difference does not appear.

In this way, in Example 1, the dot alignment is determined so that only one dot smaller than one pixel size would be arranged in 1 pixel (1 pixel of 600 dpi) corresponding to an area represented with density at n (n is an integer at least 3) density levels (n tones). Precisely, in order to represent the density at the level (the tone level 2) that is next higher than the level (the tone level 1) at which one small dot is used, the dot alignment is determined so that a large dot would be used instead of using two small dots. This dot alignment makes it possible to reduce the coverage change, and thereby to reduce the banding problem caused by the coverage change.

However, even though an image at the level 2 is in good condition, this does not necessarily ensure the obtaining of images in good condition at all tone levels.

Figure 12A:
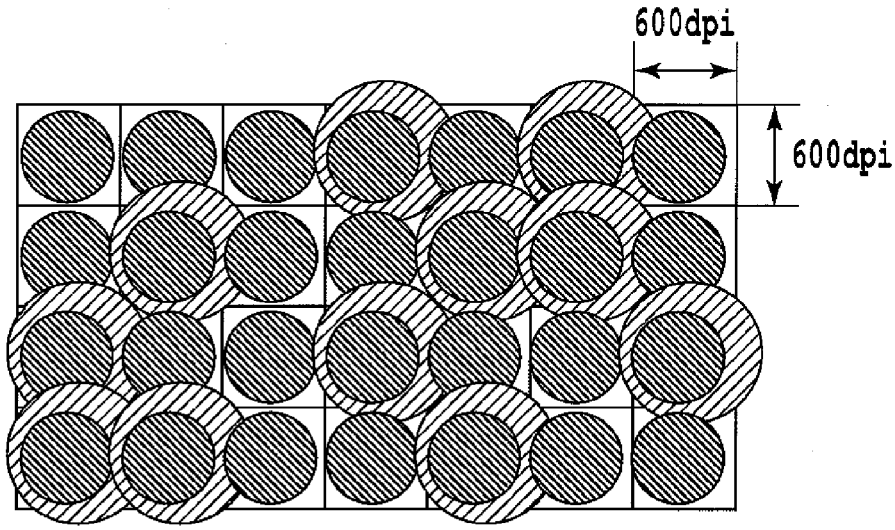
FIGS. 12A and 12B are diagrams showing dot alignment states in cases of having the ink application amounts per unit area substantially equal to those of FIGS. 3A and 3B.
Figure 12B:
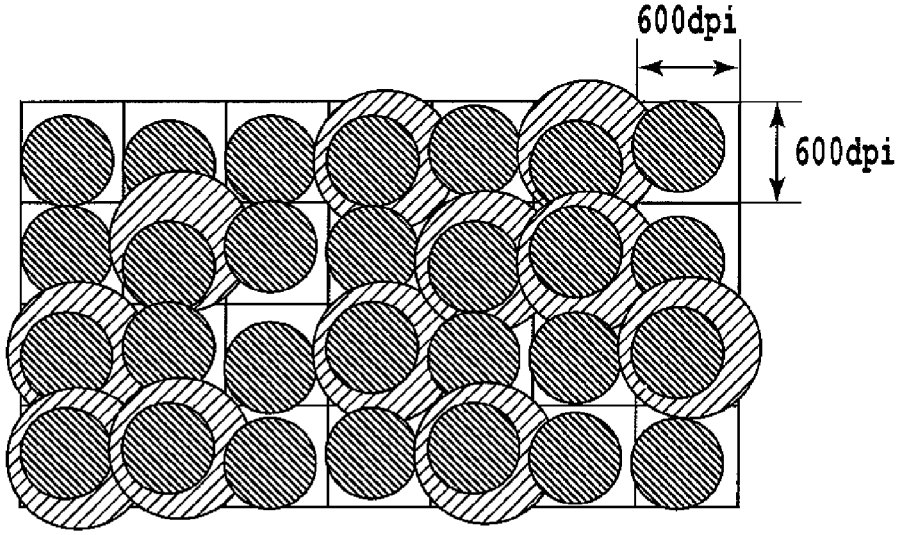

FIGS. 12A and 12B are diagrams, in comparison with FIGS. 3A and 3B, showing dot alignment states that are respectively printed so as to have the ink application amounts per unit area substantially equal to those of FIGS. 3A and 3B. At the level 2 of the INDEX patterns shown in FIG. 2, two small dots, that is, a total ink amount of 2 pl×2=4 pl is applied onto 1 pixel of 600 dpi. Here, consider a case where a larger area is printed by combining the INDEX patterns shown in FIG. 10 in order to obtain the ink application amount same as in the case of printing with the INDEX pattern at the level 2 in FIG. 2. When the same ink amount is obtained, the patterns at the level 1 and the level 2 in FIG. 10 are distributed at a ratio of 6:4.

When there is no variation in sub scans as shown in FIG. 12A, dots each being larger than a pitch of the image resolution in the sub scan direction are distributedly printed, and thereby lines, like those shown in FIG. 3A, in a main scan direction are not observed. The coverage on a printing medium is not 100%, and white background portions are distributed in places.

On the other hand, even when there are variations in sub scans as shown in FIG. 12B, the variations influence the coverage and lightness of an entire image to a small extent, that is, white background portions appear at positions being a little bit different from those of FIG. 12A, because the image contain dots each being larger than the pitch of the image resolution in the sub scan direction.

As described above, an image uniformly printed with banding reduced can be obtained by preparing the INDEX patterns causing large dots to be printed more preferentially as in Example 1 even at a tone level, at which only small dots are conventionally used for printing.

Hereinafter, descriptions will be provided for an effect in controlling a temperature rise in a head in a case of using the INDEX patterns in Example 1. The descriptions for the effect in controlling the temperature rise in the head in Example 1 will be described below by comparing the case (Example 1) of using the INDEX patterns in FIG. 10 with the case (the conventional example) of using the INDEX patterns in FIG. 2.

Figures 5A, 5B:
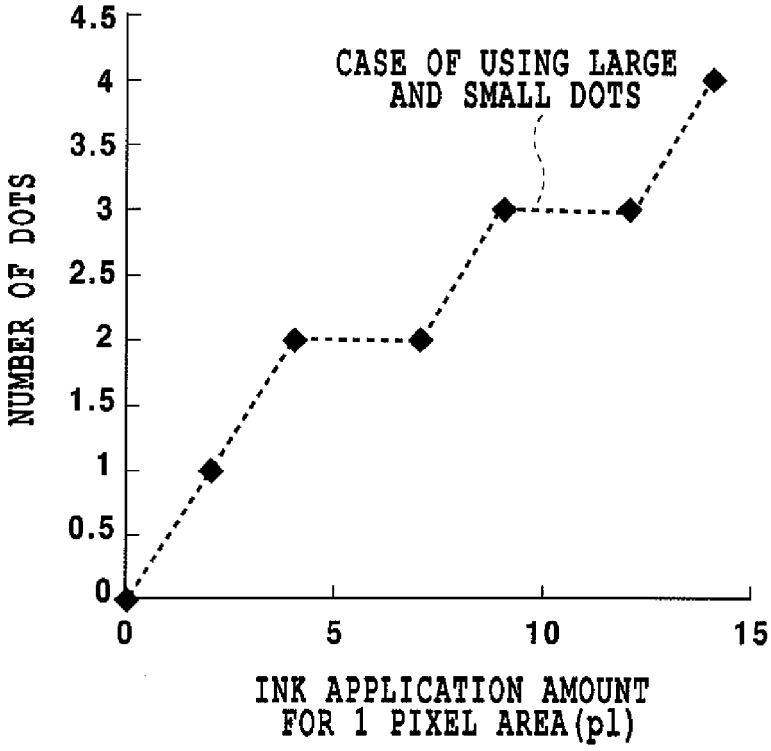
FIG. 5A is a table showing the number of printed small dots, the number of printed large dots, the total number of the small and large dots and the ink application amount in one pixel of 600 dpi with respect to each inputted level, in a case of using the INDEX patterns shown in FIG. 2.
FIG. 5B is a graph showing an ink amount applied to one pixel of the image resolution, and the average value of the number of dots printed to apply the ink amount.

FIG. 5A is a table showing the number of printed small dots, the number of printed large dots, the total number of the small and large dots and the ink application amount in one pixel of 600 dpi with respect to each inputted level, in a case of using the INDEX patterns shown in FIG. 2.

In addition, FIG. 5B is a graph showing an ink amount applied to one pixel of the image resolution, and the average value of the number of dots printed to apply the ink amount. The horizontal axis indicates the amount of ink (pl) applied on average to one pixel of 600 dpi when a uniform image is printed in a certain range of area at various density levels. The vertical axis indicates the average value of the total number of large and small dots printed in each pixel to apply each of the amounts of ink thereto.

In each printing element, more drive energy is necessary for ejecting a large amount of ink than that for ejecting a small amount of ink, and thereby the heating value inside the ink path is also larger. There is almost no difference, however, between a large dot and a small dot in terms of a degree of temperature rise inside the print head, because a larger amount of heated ink is ejected for printing the large dot than that for printing the small dot. The present inventors examined and found out that the degree of temperature rise in a print head does not depend on the amount of ejected ink, but mainly depends on the number of ejections.

To be more precise, in the case of FIGS. 5A and 5B, the temperature of the print head is more likely to rise at the levels 1, 2 and 4 than in the case of using a large dot. In contrast, the temperature thereof is less likely to rise at the level 5. However, tone levels frequently used for printing general images are not as high as the level 5, and a majority thereof is at the level 2 or below in the case of Example 1. Accordingly, in the conventional ink jet printing apparatus which uses a print head capable of printing large and small dots, and in which the INDEX patterns shown in FIG. 2 are introduced, the temperature of the print head is likely to rise, which may easily lead to a reduction in a printing speed.

Figures 13A, 13B:
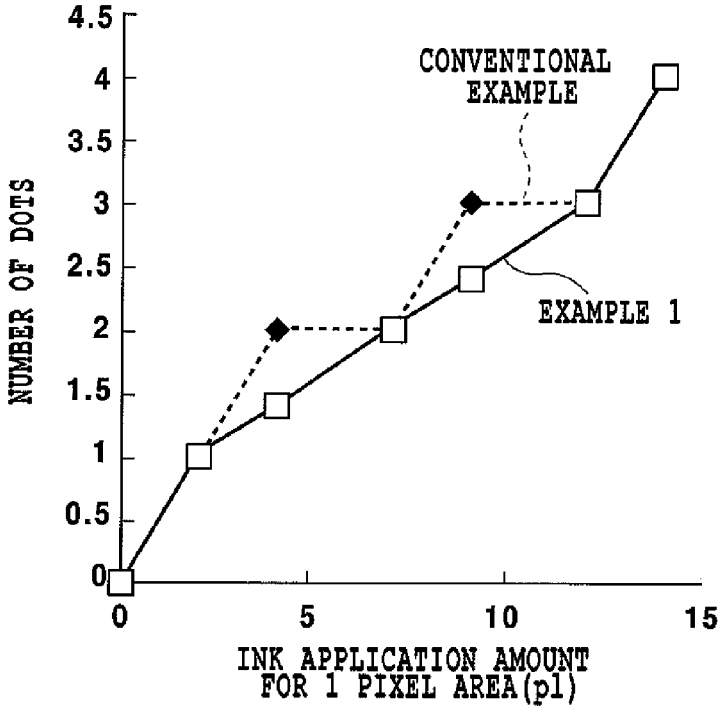
FIG. 13A is a table showing the number of printed small dots, the number of printed large dots, the total number of the small and large dots and the ink application amount in one pixel of 600 dpi with respect to each inputted level, in a case of using the INDEX patterns shown in FIG. 10.
FIG. 13B is a graph showing an ink amount applied to one pixel of the image resolution, and the average value of the number of dots printed to apply the ink amount, together with the curve shown in FIG. 5B.

On the other hand, FIG. 13A is a table showing the number of printed small dots, the number of printed large dots, the total number of the small and large dots and the ink application amount in one pixel of 600 dpi corresponding to each inputted level, in a case of using the INDEX patterns shown in FIG. 10. FIG. 13A also shows an average number of dots or an average ink application amount for obtaining an ink application amount corresponding to each of the inputted levels (7 values) of the INDEX patterns shown in FIG. 2.

Moreover, FIG. 13B is a graph showing an ink amount applied to 1 pixel of the image resolution, and the average value of the number of dots printed to apply the ink amount, together with the curve shown in FIG. 5B. As is clear from FIGS. 13A and 13B, the number of ejections can be reduced by using the INDEX patterns of Example 1, even in cases of obtaining the ink application amounts equivalent to those of the levels 2 and 4 in the INDEX patterns shown in FIG. 2. More specifically, the number of ejections can be reduced down to 70% of the conventional number at the level 2, and can be reduced down to 80% thereof at the level 4. As a result, the temperature rise in the print head is reduced more than in the conventional case, thereby avoiding a reduction in the printing speed with temperature rise.

In Example 1, the descriptions have been provided for the example of printing an image at the image resolution of 600 dpi by using the two levels of dot sizes of 5 pl and 2 pl. Such a combination of parameters, however, does not place limitations on the effect of the present invention. It suffices to use at least two kinds of dots including a dot smaller and a dot larger than a pitch of a resolution in a sub scan direction. For example, in a case where an image resolution is 1200 dpi, it suffices that dot sizes include a combination of a dot with the diameter lager and a dot with the diameter smaller than 21 μm which is a pitch of the resolution.

Furthermore, the INDEX patterns shown in FIG. 10 do not also place limitations on Example 1.

Figure 14:
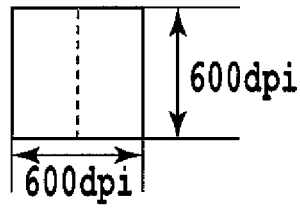
FIG. 14 is a diagram showing another example of the INDEX pattern applicable to Example 1.
Figure 14:
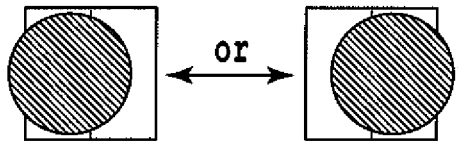
Figure 14:
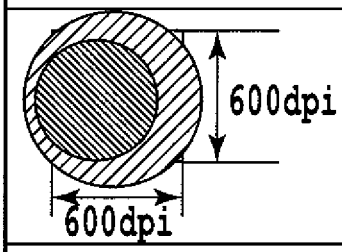
Figure 14:
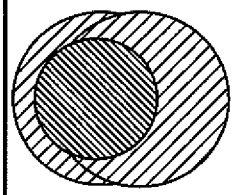
Figure 14:
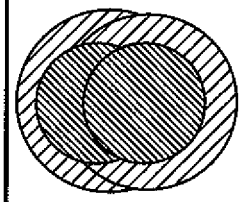

FIG. 14 is a diagram showing another example of the INDEX pattern applicable to Example 1. In FIG. 14, as a pattern corresponding to the level 1, prepared are two kinds of patterns, one of which causes one small dot to be printed on the left side of a printing pixel, and the other of which causes one small dot to be printed on the right side of a printing pixel. Since these two patterns are different only in the position of the small dot, the density in an image is not largely changed regardless of the use of any one of these patterns for the level 1. However, these two patterns may be changed column by column, or raster by raster, may be changed whenever a print data piece appears, or may be changed randomly, in order to render less noticeable harmful effects on an image that are attributable to variations in carriage scans and various errors included in the apparatus main body.

According to Example 1 described above, even with a print head capable of printing multiple sizes of dots, it is possible to perform printing with banding and the temperature rise of the print head reduced, by using INDEX patterns preferentially allowing a large dot to be printed in a low tone area.

EXAMPLE 2

Hereinafter, Example 2 of the present invention will be described. A print head used in Example 2 is capable of ejecting each color ink of amounts of three levels. For a large dot, the ejection amount is 15 pl, and the diameter is 80 μm. For a middle dot, the ejection amount is 5 pl, and the diameter is 60 μm. In addition, for a small dot, the ejection amount is 2 pl, and the diameter is 35 μm. The middle dot is equivalent in size to the large dot in Example 1.

Incidentally, in Example 2, the diameter of the small dot is smaller than a pitch of an image resolution in a sub scan direction, and the diameters of the middle and large dots are larger than the pitch of the image resolution in the vertical direction.

Figure 15:
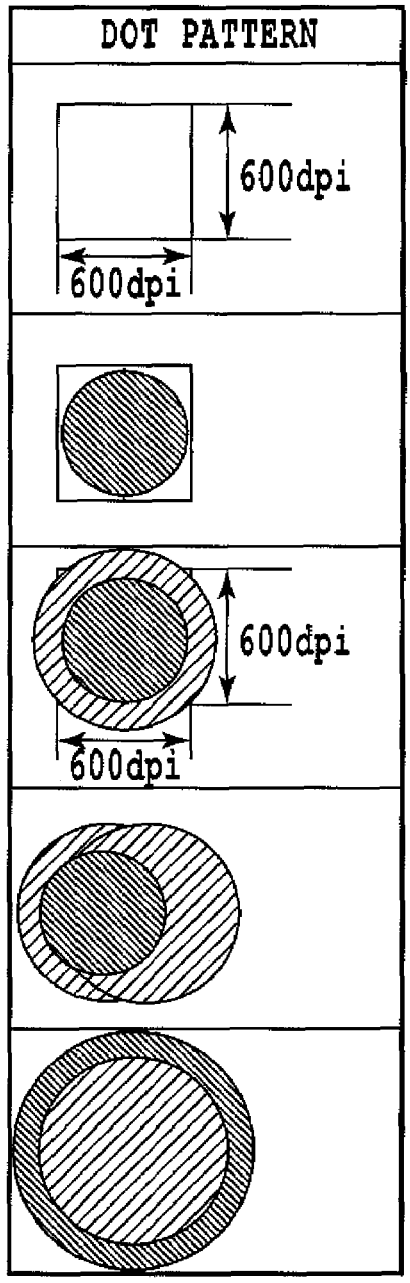
FIG. 15 is a diagram for explaining INDEX patterns used in Example 2.

FIG. 15 is a diagram for explaining INDEX patterns used in Example 2 in comparison with INDEX patterns in FIG. 2 or 10. In Example 2, density data containing 5-valued levels with an image resolution of 600 dpi are to be printed by using patterns each specifying the numbers of large, middle and small dots to be printed in each printing pixel with the same resolution of 600 dpi.

In the case of Example 2, the numbers of small and middle (corresponding to large of Example 1) dots to be printed in one pixel of 600 dpi at the levels 1 to 3 are the same as in the case of Example 1. However, in Example 2, the printing resolution is also 600 dpi that is equal to that of the image resolution, and accordingly all the printed dots are each arranged at a substantially center of a pixel of 600 dpi. Incidentally, at the level 3, two middle dots are arranged off the center for the purpose of showing that two dots are printed in one pixel.

At the level 4, two large dots (corresponding to middle dots of Example 2) and two small dots are assigned in Example 1, while one middle dot and one large dot are assigned in Example 2. The amount of ink applied to one pixel is 2 pl×2+5 pl×2=14 pl in Example 1, while the amount thereof is 15 pl+5 pl=20 pl in Example 2. Consequently, in the case of Example 2, the ink application amount at the level 4 is lager, and thereby the maximum value of density that can be represented is higher than in the case of Example 1.

In the configuration in which dot sizes of multiple levels are prepared as described above, the larger the ejection amount of the largest dot is set, the higher the maximum value of density that can be represented can be set. However, the tone may jump as in the case of Example 2 where the ejection amount (20 pl) of the large dot is four times larger than that (5 pl) of the medium dot that is one size smaller than the large dot. To be more precise, the ink application amount at the level 2 of Example 2 is 5 pl+2 pl=7 pl, while the application amount at the level 3 is 20 pl even only by employing one large dot. This amount is approximately three times larger than that of the level 2. The density represented at all the levels may not always be of linearity. However, when the density difference between two successive levels is extremely large the gradation of an image is likely to be damaged.

For this reason, two middle dots are arranged at the level 3 in Example 2. With this arrangement, the tone continuity between the level 2 and the level 4, at which a large dot is printed, can be maintained preferable. In Example 2, the effect can be obtained as long as at least one dot larger than the pitch of the resolution in the sub scan direction is arranged in an area at a level higher than a density level (level 1) at which only one dot (small dot) smaller than the pitch of the resolution in the sub scan direction is arranged. When this condition is satisfied, variations in sub scans are less likely to appear on a printed image, which is an object achieved by the present invention. Accordingly, as long as at least one dot larger than a pitch of a resolution in a sub scan direction is arranged in a pixel, the present invention does not place limitations on a combination of dots, and two middle dots can be arranged in one pixel as is the case with Example 2.

EXAMPLE 3

Example 3 will be described below. In Example 3, the n-valued processing to be described by referring to FIG. 9 quantizes multiple-valued density data into 6-valued density data (levels 0 to 5).

Figure 16:
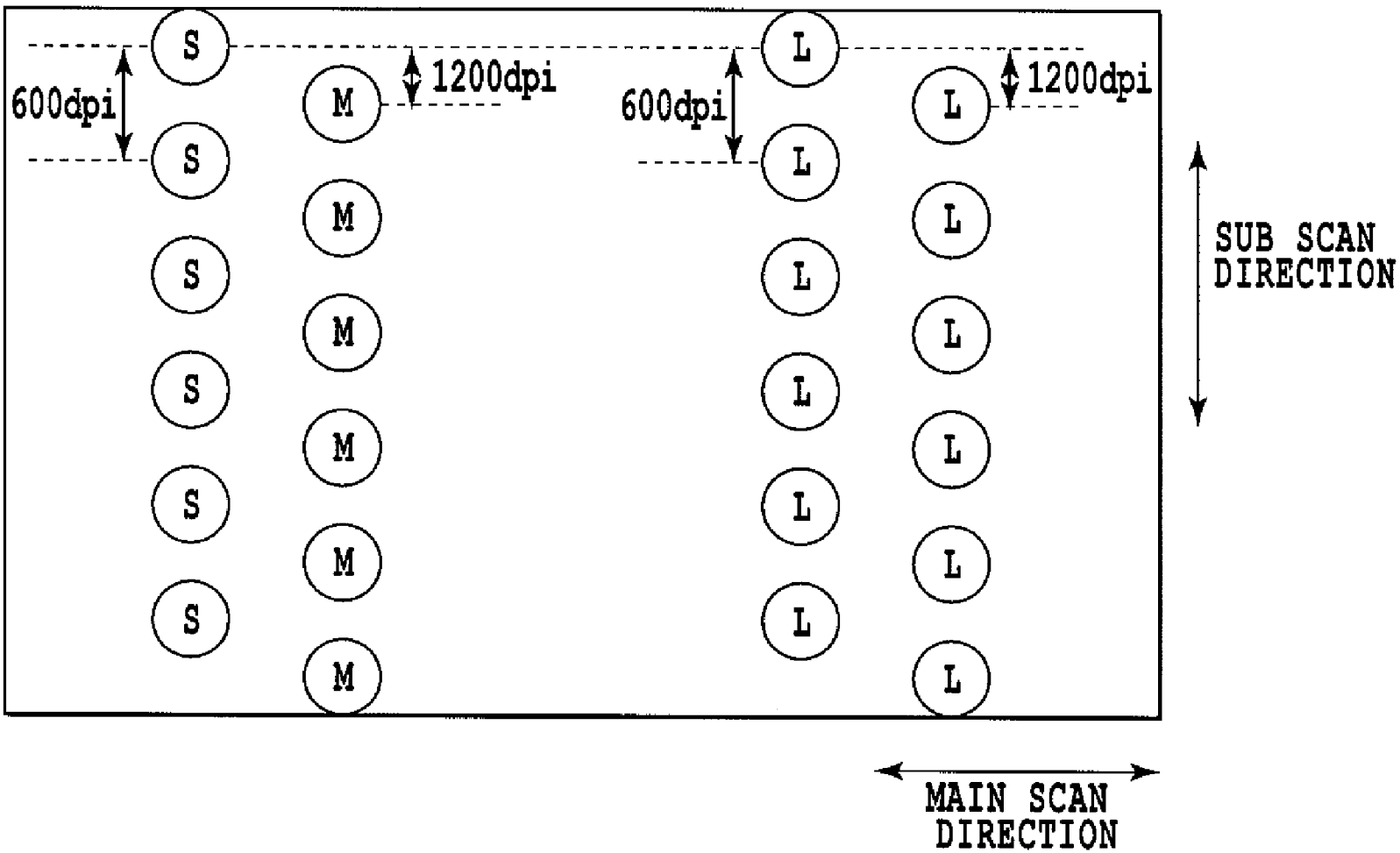
FIG. 16 is a schematic diagram for explaining nozzle arrays of a print head used in Example 3.

FIG. 16 is a schematic diagram for explaining nozzle arrays of a print head used in Example 3. In FIG. 16, S denotes a nozzle ejecting an ink droplet of 1 pl, and printing a small dot with the diameter of approximately 25 μm; M denotes a nozzle ejecting an ink droplet of 2 pl, and printing a middle dot with the diameter of approximately 35 μm; and L denotes a nozzle ejecting an ink droplet of 5 pl, and printing a large dot with the diameter of approximately 60 μm. In each of ejection port arrays for small and middle dots, ejection ports are arranged with density of 600 dpi in a sub scan direction. These two arrays are arranged to be shifted from each other in the sub scan direction by one pixel of 1200 dpi. On the other hand, an ejection port array for large dots includes two ejection port arrays, and the two arrays are arranged to be shifted from each other as similar to the arrangement of the small and middle dots.

Figure 17:
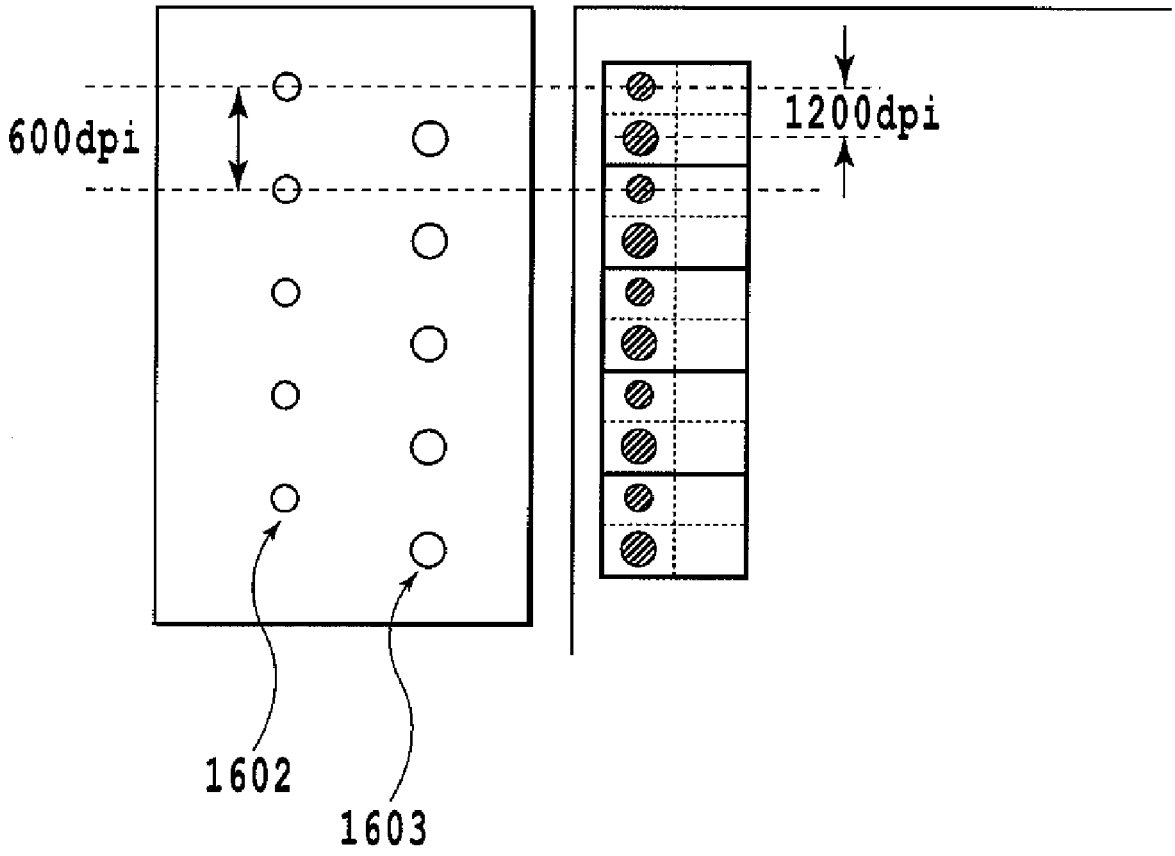
FIG. 17 is a diagram for explaining a dot alignment state printed by an ejection port array for small dots and an ejection port array for middle dots shown in FIG. 16.

FIG. 17 is a diagram for explaining a dot alignment state printed by an ejection port array 1602 for small dots and an ejection port array 1603 for middle dots. Each of the ejection port arrays makes a print with 600 dpi in the sub scan direction in a single print scan. Thereby, a print at 1200 dpi in the sub scan direction can be made by combining small and middle dots. The two arrays of the ejection port for large dots are capable of making a print at 1200 dpi in the sub scan direction, although FIG. 17 does not show. In Example 3, density data of an image resolution of 600 dpi are handled by using a print head that achieves a printing resolution of 1200 dpi by combining large, middle and small dots.

Figure 18:
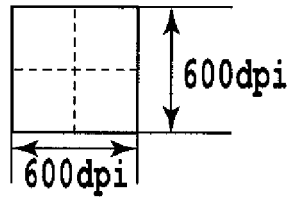
FIG. 18 is a schematic diagram for explaining INDEX patterns of Example 3.
Figure 18:
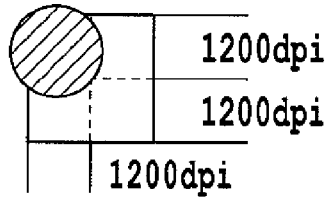
Figure 18:
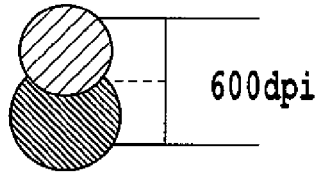
Figure 18:
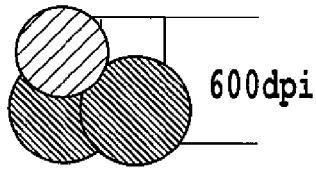
Figure 18:
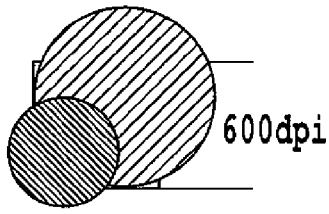
Figure 18:
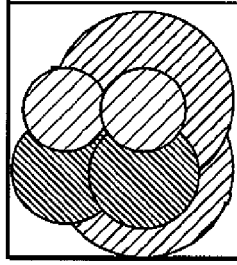

FIG. 18 is a schematic diagram for explaining INDEX patterns of Example 3 in comparison with the INDEX patterns in FIGS. 2, 10 and 15. FIG. 18 shows patterns each specifying whether or not to print large, middle and small dots in each printing pixel of 1200 dpi (vertical)×1200 dpi (horizontal) for density data having an image resolution of 600 dpi, and including 6-valued levels (levels 0 to 5). At the level 1, one small dot is printed in one pixel of 600 dpi. The small dot in Example 3 has a diameter smaller than those of Examples 1 and 2, thus leading to a further reduction of granularity at a highlight area.

At the level 2, a middle dot is added to the pattern at a position adjacent to the small dot printed at the level 1 in the sub scan direction. A characteristic of Example 3 is to preferentially arrange a dot at such an adjacent position in the sub scan direction as described above. Unlike Examples 1 and 2, Example 3 has the printing resolution of 1200 dpi also in the sub scan direction. Accordingly, the same effect as in aforementioned Examples 1 and 2 can be obtained by continuously arranging dots in the sub scan direction, as long as the dots are larger than one pixel width (21 μm) of the printing resolution (1200 dpi) even though being smaller than one pixel width (42 μm) of the image resolution (600 dpi).

Figure 19A:
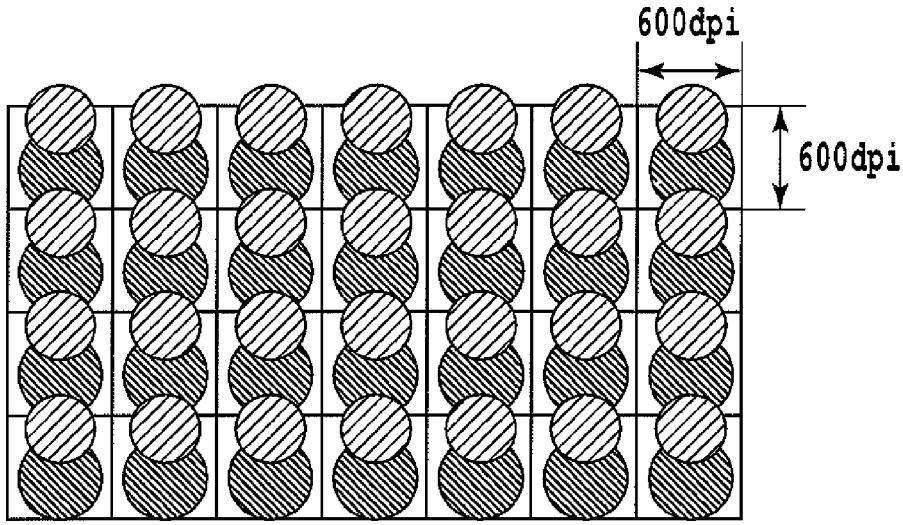
FIGS. 19A and 19B are diagrams each for explaining a dot alignment state in a case of continuously printing data of the level 2 in a certain range of area, in comparison with FIG. 3.
Figure 19B:
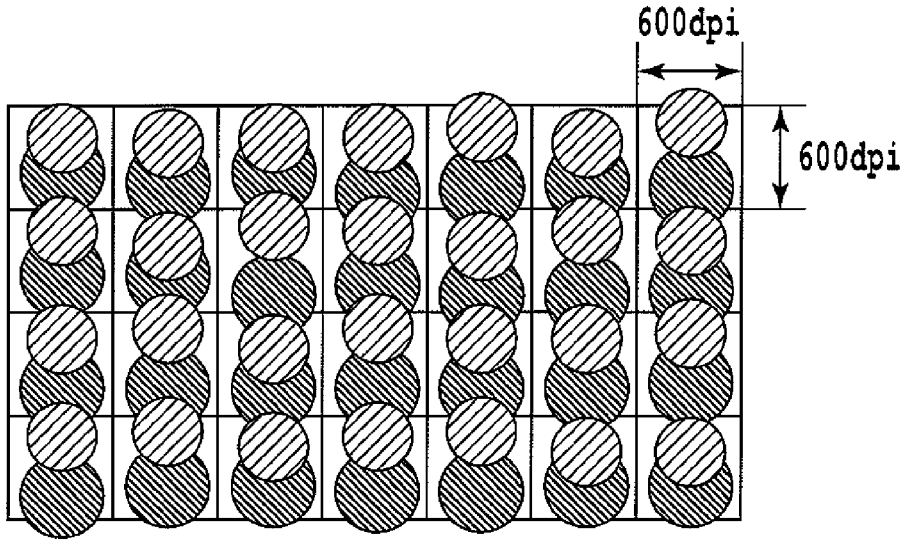

FIGS. 19A and 19B are diagrams each for explaining a dot alignment state in a case of continuously printing data of the level 2 in a certain range of area, in comparison with FIG. 3.

In Example 3, dots adjacent in the sub scan direction are overlapped and connected with each other, and coverage in the sub scan direction is 100% or more. For this reason, even when there are variations in sub scans (see FIG. 19B), areas where dots overlap with each other increase or decrease only to a small extent, and thus white background portions do not change in size as in FIG. 3B. In other words, even under influence of the variations in the sub scan amount, the coverage on a printing medium does not change largely, which makes the lightness of an image stable.

In Example 3, as is the case with aforementioned Examples 1 and 2, there is no particular limitation on a combination of dots in dot patterns at the levels 3 and higher, as long as the combination satisfies a condition that the coverage in the sub scan direction exceeds 100%.

Incidentally, at the level 2 in Example 3, one middle dot is added to the pattern at the level 1 at which one small dot is printed, but an added dot is not limited to the middle dot. The three kinds of dots used in Example 3 each have the diameter larger than one pixel area of the printing resolution. Accordingly, whichever of these dots are printed, the condition that "the coverage in the sub scan direction exceeds 100%" is satisfied. As a result, the effect of the present invention can be obtained. For example, two small dots may be printed adjacently in a sub scan direction at the level 2 by changing the entire ejection port array for middle dots, described by referring to FIG. 16, to another ejection port array for small dots.

EXAMPLE 4

Example 4 will be described below. In Example 4, the n-valued processing process described by referring to FIG. 9 quantizes multiple-valued density data into 5-valued density data (levels 0 to 4) as similar to Examples 1 and 2.

Figure 20:
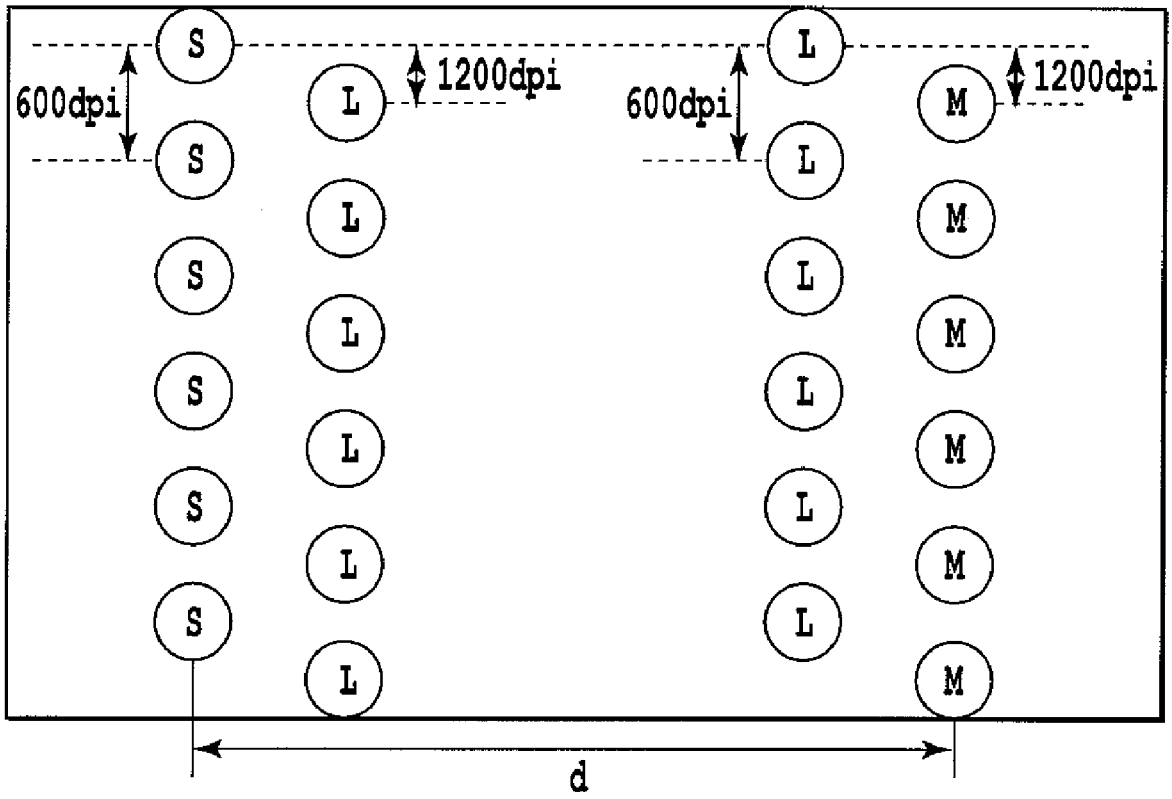
FIG. 20 is a schematic diagram for explaining nozzle arrays of a print head used in Example 4.

FIG. 20 is a schematic diagram for explaining nozzle arrays of a print head used in Example 4. In FIG. 20, S, M and L respectively denote ejection port arrays for small, middle and large dots which eject the same amounts of ink and print dots with the same diameters as those in Example 3. The positional relationship between the ejection port arrays for small and middle dots is also the same as in Example 3. In addition, it is also the same as Example 3 that a print of 1200 dpi is made in a sub scan direction by combining these two arrays. However, in Example 4, these two arrays are arranged at a longer distance in a main scan direction than in the configuration of Example 3. When the print head is inclined in a main scan direction, the distance between these two arrays appears as displacement in a sub scan direction of print positions.

Figure 21:
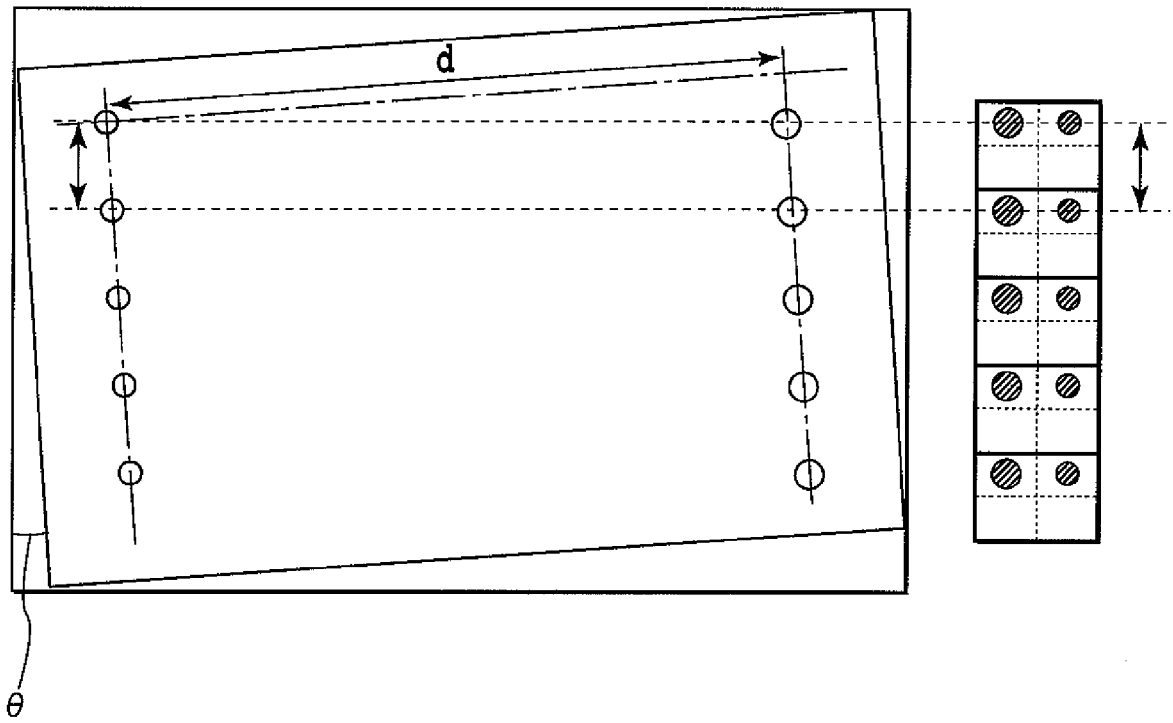
FIG. 21 is a diagram for explaining displacement of print positions attributable to an inclination of a print head.

FIG. 21 is a diagram for explaining displacement of print positions attributable to an inclination of a print head. FIG. 21 shows a print position of each dot in a case of performing main scans with a print head including a small dot array and a middle dot array arranged at a distance of d=15 mm, and being inclined by an angle θ. The print head of Example 4 is designed so that print positions of small dots and print positions of middle dots are alternately arranged to be shifted in a sub scan direction by one pixel (approximately 21 μm) of 1200 dpi. However, in a case where the inclined print head includes the two arrays arranged at a long distance, the positional relationship between the print positions may be distorted on a printing pixel basis. FIG. 21 shows that the middle dots are shifted relative to the small dots by approximately 21 μm, and that the two kinds of dots are printed at substantially same positions in the sub scan direction.

Under this condition, gradation cannot be appropriately represented even with the INDEX patterns in Example 3 are employed, because the middle and small dots overlap with each other at the levels 2 and 3. At the level 3, especially, a dot alignment state becomes similar to the dot alignment pattern shown in FIGS. 3A and 3B, and thereby the variations in conveyance is more likely to have harmful effects on representation of gradation.

Figure 22:
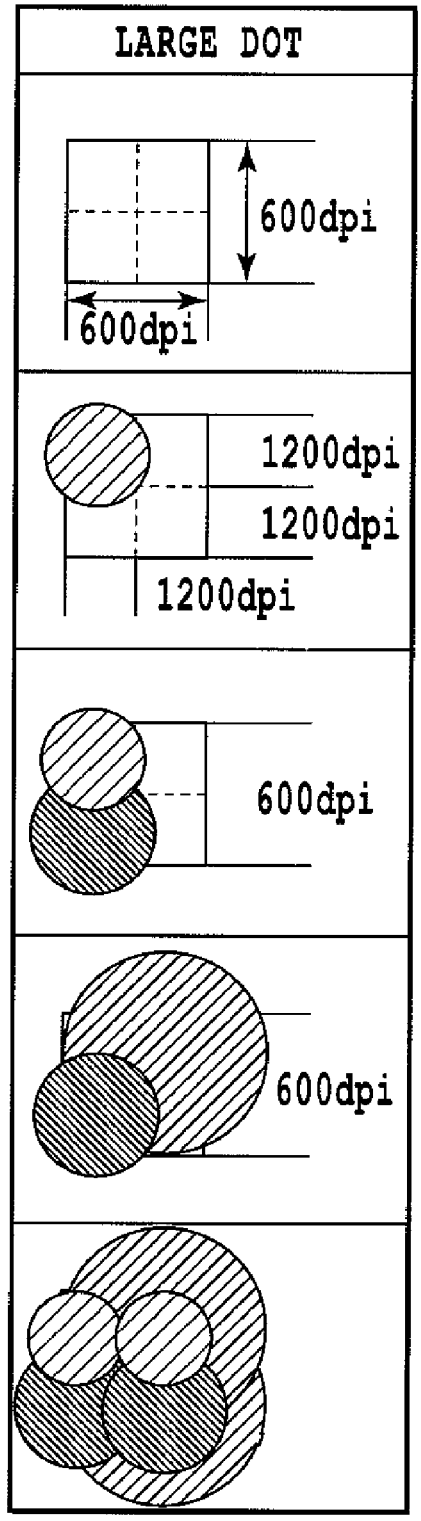
FIG. 22 is a schematic diagram for explaining INDEX patterns of Example 4 in comparison with the INDEX patterns in FIG. 18.

FIG. 22 is a schematic diagram for explaining INDEX patterns of Example 4 in comparison with the INDEX patterns of Example 3 shown in FIG. 18. FIG. 22 shows patterns each specifying whether or not to print large, middle and small dots in each printing pixel of 1200 dpi (vertical)×1200 dpi (horizontal), corresponding to density data having an image resolution of 600 dpi, and including 5-valued levels (levels 0 to 4). At the level 3 in Example 4, two middle dots included at the level 3 in Example 3, at which an influence of an inclination of the print head is more likely to appear, are replaced with a large dot. In this way, to print a dot with the diameter larger than one pixel area of the image resolution (600 dpi) from a relatively low tone level is a countermeasure against the displacement of print positions attributable to an inclination of the print head, and is a characteristic of Example 4. This is because the coverage does not change even with the print head inclined to a small extent, if at least one dot larger than one pixel area is printed in a pixel. Moreover, the level 3 of Example 4 is the same as the level 2 of Example 1 in that a dot of 2 pl and a dot of 5 pl are printed in one pixel of 600 dpi. Accordingly, banding attributable to variations in conveyance is reduced by the same effect as in Example 1.

It has been explained hereinabove that printing "a dot with a diameter larger than one pixel area of an image resolution" is effective in preventing damage attributable of the inclination of the print head. To be more precise, in the case of Example 4, it is effective to print a large dot with a diameter (60 μm) larger than one pixel width (42 μm) of 600 dpi. However, when a print head is inclined as is the case with Example 4, strictly speaking, the resolution of an ejection port array arranged on the print head is different from the resolution at which dots are actually arranged on a printing medium. In other words, the resolution of an image formed on a printing medium is changed according to the resolution of nozzles in a print head and an inclination of the print head. For this reason, it may not be said that printing "a dot with a diameter larger than one pixel area of an image resolution" is always effective even when the image resolution is 600 dpi.

However, if print positions are displaced to the approximately same extent as in Example 4 described by referring to FIG. 21, it can be said that the resolution of nozzles of a print head and the resolution of an image formed on a printing medium are substantially equal to each other in fact. The reason for this will be briefly described below. The ejection port array for middle dots in Example 4 is arranged at the position at a distance of approximately d=15 mm away from the ejection port array for small dots. A dot printed by this ejection port array for middle dots is printed to be shifted in the sub scan direction by approximately 21 μm. This means that an inclination amount θ is Sin θ=21 μm/15 μm, and is almost 0. On the other hand, the distance L between two middle dots actually arranged in the sub scan direction on a printing medium can be expressed as $$L=D\times\cos\theta=D\times(1-\mathrm{Sin}\,2\theta)1/2\approx D$$

where D denotes the distance between nozzles arranged at 600 dpi. As is clear from this, the distance L between two middle dots is substantially equal to the distance D between nozzles. Accordingly, in other words, Example 4 shows that printing a dot with the diameter larger than the nozzle pitch of the print head is effective in preventing damage attributable to the inclination of the print head.

Figure 23:
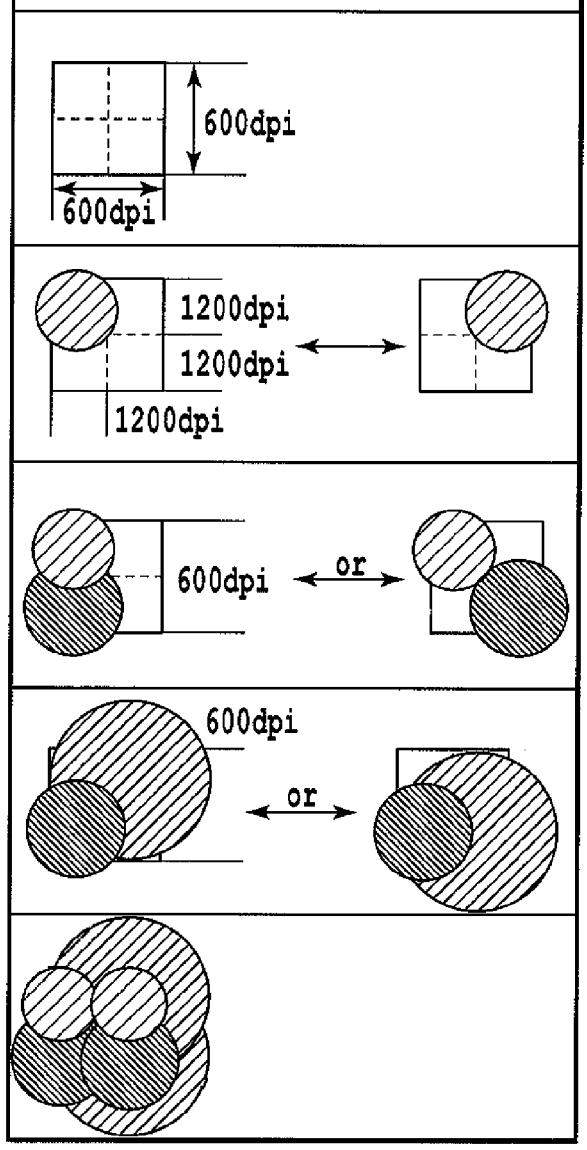
FIG. 23 is a diagram showing another example of INDEX patterns applicable to Example 4.

FIG. 23 is a diagram showing another example of INDEX patterns applicable to Example 4. In FIG. 23, there are prepared two kinds of patterns corresponding to the level 1, one of which allows one small dot to be printed in the upper-left printing pixel, and the other one of which allows one small dot to be printed in the upper-right printing pixel. In addition, there are prepared two kinds of patterns corresponding to the level 2, one of which allows one middle dot to be printed in the lower-left printing pixel in addition to one small dot, and the other one of which allows one middle dot to be printed in the lower-right printing pixel in addition to one small dot. Moreover, there are prepared two kinds of patterns corresponding to the level 3, one of which allows one large dot to be added in the upper-right printing pixel, and the other one of which allows one large dot to be added in the lower-right printing pixel. Preparing multiple patters corresponding to the same level, as described above, is effective in making less noticeable harmful effects on an image that are attributable to variations in carriage scans and various errors included in the apparatus main body. Various effects can be obtained by changing these multiple kinds of patterns column by column or raster by raster, by changing them every time a print data piece appears, or by changing them randomly. Although there are two kinds of patterns corresponding to each level in the case of FIG. 23, it is of course possible to prepare a larger number of patterns.

OTHER EXAMPLES

Note that it is not necessary to apply the INDEX patterns of each of the examples described above to all the ink colors used in the printing apparatus, uniformly. Precisely, the INDEX patterns may be uniformly used for all the ink colors, or may be used only for an ink color that causes banding attributable to variations in conveyance to be more noticeable.

Moreover, even when printing is made with the same ink color, banding attributable to variations in sub scans appears in various ways depending on a printing mode and a kind of printing medium. Accordingly, it is also possible to employ a configuration which using different types of image processing and different INDEX patterns depending on printing modes and kinds of printing media. For example, in a case of employing multi-pass printing in a serial-type ink jet printing apparatus, the greater the number of multi-passes, the less likely variations in sub scan is to appear in an image. For this reason, another possible configuration is that INDEX patterns according to the present invention are adapted in a high-speed printing mode with a small number of multi-passes, and conventional INDEX patterns are adapted in a printing mode with a large number of multi-passes. As a matter of course, such conventional INDEX patterns may include conventional ones as described by using FIG. 2 in the section of "DESCRIPTION OF THE RELATED ART."

In addition, various modified examples of patterns having characteristics of the dot alignments presented in the above examples can be obtained in addition to the patterns presented in this description. The scope of the present invention also includes even a case of using any of these modified examples depending on an ink color, a printing mode, a kind of a printing medium or the like.

Note that, although the foregoing examples have been described as the system in which a series of image processing steps are shared by the host apparatus and the printing apparatus as shown in FIG. 9, the present invention is not limited to such a configuration. More steps may be performed by the host apparatus, or by the printing apparatus. For example, the image processing steps (F111, F112 and F113) employed in the host apparatus F101 in FIG. 9 may be employed in the printing apparatus F102.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-227177, filed Aug. 23, 2006, which is hereby incorporated by reference herein in its entirety.

What is claimed is:

1. An image printing apparatus for printing an image on a printing medium by using a print unit for printing dots of a plurality of sizes, comprising:

a converting unit that converts density data of a pixel into a dot pattern corresponding to a density level of the density data of the pixel; and a driving unit that drives said printing unit to print one or more dots to the pixel on the printing medium based on the dot pattern converted by said converting unit, wherein the dots of the plurality of sizes include at least a small dot of a size which is smaller than a size of the pixel and a large dot of a size which is larger than the size of the pixel, and wherein the density data indicating a first density level is converted into a dot pattern for printing only one small dot, and the density data indicating a second density level that is next higher than the first density level is converted into a dot pattern for printing at least one large dot.

2. An image printing apparatus according to claim 1, wherein the dot pattern for printing at least one dot is a dot pattern for printing one large dot and one small dot.

3. An image printing apparatus for printing an image on a printing medium by performing a scanning operation for scanning a print unit capable of printing dots of a plurality of sizes to the printing medium in a scanning direction and a conveying operation for conveying the printing medium in a conveying direction crossing the scanning direction, comprising:

a converting unit that converts density data of a pixel into a dot pattern corresponding to a density level of the density data of the pixel; and a driving unit that drives the print unit to print one or more dots to the pixel on the printing medium in accordance with the dot pattern converted by said converting unit;

wherein the dots of the plurality of sizes include at least a small dot smaller than the pixel and a large dot larger than the small dot; and wherein the density data indicating a first density level is converted into a dot pattern for printing only one small dot, and the density data indicating a second density level that is next higher than the first density level is converted into a dot pattern for printing the small and large dots at different positions in the conveying direction so that a size in the conveying direction of a dot formed with the small and large dots is larger than a size of the pixel in the conveying direction.

4. An image printing apparatus for printing an image on a printing medium by using a print unit for printing dots of a plurality of sizes, comprising:

a selecting unit that selects a dot pattern to be used for printing one or more dots to a pixel in accordance with a density level of the pixel, from a plurality of dot patterns corresponding to different density levels; and a driving unit that drives said printing unit to print the one or more dots to the pixel on the printing medium based on the dot pattern selected by said selecting unit, wherein the dots of the plurality of sizes include at least a small dot smaller than the pixel, a middle dot larger than the pixel, and a large dot larger than the middle dot, wherein the plurality of dot patterns includes a dot pattern for printing only one small dot, a dot pattern for printing at least one middle dot and a dot pattern for printing at least one large dot, without including a dot pattern for printing only a plurality of small dots.

5. An image printing apparatus for printing an image on a printing medium by using a print unit for printing dots of a plurality of sizes, comprising;

a selecting unit that selects a dot pattern to be used for printing one or more dots to a pixel in accordance with a density level of the pixel from a plurality of dot patterns corresponding to different density levels; and a driving unit that drives said print unit to print the one or more dots to the pixel on the printing medium based on the dot pattern selected by the selecting unit, wherein the dots of the plurality of sizes include at least a small dot smaller than the pixel and a large dot larger than the pixel, and wherein the plurality of dot patterns includes a dot pattern for printing only one small dot and a dot pattern for printing at least one the large dot, without including a dot pattern for printing only a plurality of small dots.

6. An image printing method for printing an image on a printing medium by using a printing unit for printing dots of a plurality of sizes, the method comprising the steps of:

convening density data of a pixel into a dot pattern corresponding to a density level of the density data of the pixel; and printing one or more dots to the pixel on the printing medium based on the dot pattern convened by the converting step, wherein the dots of the plurality of sizes include at least a small dot of a size which is smaller than a size of the pixel and a large dot of a size which is larger than the size of the pixel, and wherein the density data indicating a first density level is convened into a dot pattern for printing only one small dot, and the density data indicating a second density level that is next higher than the first density level is converted into a dot pattern for printing at least one large dot.

7. An image printing method for printing an image on a printing medium by using a printing unit for printing dots of a plurality of sizes comprising the steps of:

selecting a dot pattern to be used for printing one or more dots to a pixel in accordance with a density level of the pixel, from a plurality of dot patterns corresponding to different density levels; and driving said printing unit to print the one or more dots to the pixel on the printing medium based on the dot pattern selected by the selection step, wherein the dots of the plurality of sizes include at least a small dot smaller than the pixel, a middle dot larger than the pixel, and a large dot larger than the middle dot, and wherein the plurality of dot patterns includes a dot pattern for printing only one small dot, a dot pattern for printing at least one middle dot, and a dot pattern for printing at least one large dot, without including a dot pattern for printing only a plurality of small dots.

* * * * *